US010924832B2

(12) United States Patent
Cook et al.

(10) Patent No.: US 10,924,832 B2
(45) **Date of Patent: *Feb. 16, 2021**

(54) LIGHT AND LOUDSPEAKER DRIVER DEVICE

(71) Applicant: Zuma Array Limited, London (GB)

(72) Inventors: Susan Cook, London (GB); Steve Kelly, London (GB); Morten Warren, Surrey (GB); Sam James, Hertfordshire (GB); Seongmin Hwang, London (GB)

(73) Assignee: Zuma Array Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/231,315

(22) Filed: Dec. 21, 2018

(65) Prior Publication Data

US 2019/0149902 A1 May 16, 2019

Related U.S. Application Data

(63) Continuation of application No. 15/553,914, filed as application No. PCT/GB2016/050524 on Feb. 29, 2016, now Pat. No. 10,219,061.

(30) Foreign Application Priority Data

Feb. 27, 2015 (GB) ..... 1503426

(51) Int. Cl.
*H04R 1/02* (2006.01)
*F21V 33/00* (2006.01)
(Continued)

(52) U.S. Cl.
CPC ..... *H04R 1/028* (2013.01); *F21V 33/0056* (2013.01); *H04R 9/022* (2013.01);
(Continued)

(58) Field of Classification Search
CPC ..... H04R 1/00; H04R 1/028; H04R 9/022; H04R 9/06; H04R 1/023; H04R 1/24;
(Continued)

(56) References Cited

U.S. PATENT DOCUMENTS 1,200,554 A 10/1916 Wales
2,501,968 A 3/1950 Sassin
(Continued)

FOREIGN PATENT DOCUMENTS

AU 2009278057 A1 3/2010
CN 2203517 Y 7/1995
(Continued)

OTHER PUBLICATIONS

Japanese Office Action (with English translation), dated Nov. 6, 2018, in corresponding Japanese Application No. 2017-563391, 14 pages.

(Continued)

*Primary Examiner* — William A Jerez Lora
(74) *Attorney, Agent, or Firm* — Foley & Lardner LLP

(57) ABSTRACT

A combined light and loudspeaker driver device comprising a housing supporting a loudspeaker driver, a heat removal element, electronic components and a light source. The heat removal element includes a column extending along a central longitudinal axis to a base of the housing, to meet a heat sink formed around the central longitudinal axis to the rear of the housing. The light source provides task lighting and is a heat source. It is mounted on a front end of the column distal from the heat sink at the base of the housing, to optimize conduction of heat away from the light source. The housing is generally cup shaped and has side walls. The interior of the side walls is parallel with the central longitudinal axis of the housing over the majority of the rearward
(Continued)

depth thereof resulting in a large void behind the loudspeaker diaphragm, leading to improved sound.

15 Claims, 30 Drawing Sheets

(51) Int. Cl.

| | |
|---|---|
| ***H04R 9/02*** | (2006.01) |
| *F21S 8/02* | (2006.01) |
| *F21Y 115/10* | (2016.01) |
| *H04R 1/24* | (2006.01) |
| *H04R 7/20* | (2006.01) |
| *F21V 29/71* | (2015.01) |
| *F21V 29/77* | (2015.01) |

(52) U.S. Cl.
CPC ..... *F21S 8/02* (2013.01); *F21V 29/71* (2015.01); *F21V 29/773* (2015.01); *F21Y 2115/10* (2016.08); *H04R 1/023* (2013.01); *H04R 1/24* (2013.01); *H04R 7/20* (2013.01); *H04R 2420/07* (2013.01)

(58) Field of Classification Search
CPC ... H04R 7/20; H04R 2420/07; F21V 33/0056; F21V 29/71; F21V 29/773; F21Y 2115/10; F21S 8/02
USPC ..... 381/117, 332
See application file for complete search history.

(56) References Cited

U.S. PATENT DOCUMENTS

| | | | | |
|---|---|---|---|---|
| 2,924,661 | A | 2/1960 | Messeas, Jr. | |
| 4,559,584 | A | 12/1985 | Kuwahata et al. | |
| 4,817,163 | A | 3/1989 | Stastny | |
| 5,512,714 | A * | 4/1996 | Fenton | H04R 1/24 181/144 |
| 5,748,760 | A | 5/1998 | Button | |
| 5,980,057 | A | 11/1999 | Christie | |
| 6,373,957 | B1 * | 4/2002 | Stewart | H04R 9/022 381/397 |
| 7,123,738 | B1 | 10/2006 | Mizone et al. | |
| 9,028,212 | B1 * | 5/2015 | Tom | F04D 25/12 416/5 |
| 9,294,842 | B2 * | 3/2016 | Qiu | H04R 31/006 |
| 2003/0021103 | A1 | 1/2003 | Christie | |
| 2004/0085773 | A1 | 5/2004 | Santa Cruz et al. | |
| 2004/0256630 | A1 * | 12/2004 | Cao | F21K 9/232 257/98 |
| 2006/0033454 | A1 | 2/2006 | Mathews et al. | |
| 2006/0177088 | A1 * | 8/2006 | Howard | H04R 1/023 381/391 |
| 2007/0003100 | A1 | 1/2007 | Liu | |
| 2008/0285257 | A1 | 11/2008 | King | |
| 2008/0298045 | A1 * | 12/2008 | Wright | F21V 33/0056 362/86 |
| 2009/0196016 | A1 | 8/2009 | Massara et al. | |
| 2010/0316247 | A1 | 12/2010 | Ding | |
| 2012/0230499 | A1 * | 9/2012 | Suzuki | H04R 1/025 381/55 |
| 2013/0265563 | A1 * | 10/2013 | Vogt | G01S 7/495 356/4.01 |
| 2013/0294639 | A1 * | 11/2013 | Glei neir | H04R 1/028 381/397 |
| 2015/0117698 | A1 * | 4/2015 | Bullimore | H04R 7/16 381/398 |
| 2016/0119717 | A1 * | 4/2016 | Jensen | H04R 7/18 181/172 |
| 2016/0212543 | A1 * | 7/2016 | Kochendoerfer | H04R 9/022 |

FOREIGN PATENT DOCUMENTS

| | | | |
|---|---|---|---|
| CN | 201114660 | Y | 9/2008 |
| CN | 101459863 | A | 6/2009 |
| CN | 201533404 | U | 7/2010 |
| CN | 102032543 | A | 4/2011 |
| CN | 102685651 | A | 9/2012 |
| CN | 103281658 | A | 9/2013 |
| CN | 203431603 | U | 2/2014 |
| CN | 203590452 | U | 5/2014 |
| CN | 204062588 | U | 12/2014 |
| DE | 19805508 | A1 | 8/1999 |
| DE | 201 12 892 | U1 | 11/2001 |
| DE | 20 2009 015115 | U1 | 1/2010 |
| DE | 202009015115 | U1 | 1/2010 |
| EP | 0 099 932 | A1 | 2/1984 |
| EP | 0 624 049 | A2 | 11/1994 |
| EP | 0 624 049 | A3 | 11/1994 |
| EP | 2400780 | A2 | 12/2011 |
| EP | 2 498 512 | A2 | 9/2012 |
| EP | 2498512 | A2 | 9/2012 |
| EP | 2 753 098 | A2 | 7/2014 |
| GB | 2 191 362 | A | 12/1987 |
| JP | S53138827 | U | 11/1978 |
| JP | S53163119 | U | 12/1978 |
| JP | S53164134 | U | 12/1978 |
| JP | S5551513 | U | 4/1980 |
| JP | S5850592 | U | 4/1983 |
| JP | S58-085868 | U | 6/1983 |
| JP | S59-148499 | A | 8/1984 |
| JP | S59-144983 | U | 9/1984 |
| JP | H02-047887 | U | 4/1990 |
| JP | H07-154894 | A | 6/1995 |
| JP | 2001-095074 | A | 4/2001 |
| JP | 2002-096691 | A | 4/2002 |
| JP | 2002-304903 | A | 10/2002 |
| JP | 2003515899 | A | 5/2003 |
| JP | 2006-157841 | A | 6/2006 |
| JP | 2006157841 | A | 6/2006 |
| JP | 2007-073438 | A | 3/2007 |
| JP | 2007-150630 | A | 6/2007 |
| JP | 2009-118099 | A | 5/2009 |
| JP | 2010-57092 | A | 3/2010 |
| JP | 2010057092 | A | 3/2010 |
| JP | 2011-077213 | A | 4/2011 |
| JP | 2012-186700 | A | 9/2012 |
| JP | 2013101785 | A | 5/2013 |
| JP | 2013-140751 | A | 7/2013 |
| JP | 2013528893 | A | 7/2013 |
| JP | 2015002032 | A | 1/2015 |
| KR | 10-0845546 | B | 7/2008 |
| TW | 200946820 | A | 11/2009 |
| TW | 201403861 | A | 1/2014 |
| WO | 2009/067669 | A1 | 5/2009 |
| WO | 2010017702 | A1 | 2/2010 |
| WO | 2010071102 | A1 | 6/2010 |
| WO | 2010/130676 | | 11/2010 |
| WO | 2011117691 | A1 | 9/2011 |
| WO | 2014/031461 | A1 | 2/2014 |
| WO | 2016/135517 | A3 | 9/2016 |

OTHER PUBLICATIONS

Invitation to Pay Additional Fees and, Where Applicable, Protest Fee and Annex to Form PCT/ISA/206 Communication Relating to the Results of the Partial International Search, dated May 11, 2016, in corresponding International Application No. PCT/GB2016/050524, 6 pages.

International Search Report issued in International Application No. PCT/GB2016/050524 dated Oct. 19, 2016.

Written Opinion of the International Searching Authority issued in International Application No. PCT/GB2016/050524 dated Oct. 19, 2016.

Search Report under Section 17(5) issued in Application No. GB1503426.7 dated May 1, 2015.

Patents Act 1977: Search Report under Section 17(6) dated Oct. 22, 2015.

(56) References Cited

OTHER PUBLICATIONS

Patents Act 1977: Amendment to Search Report dated Oct. 26, 2015.
Patents Act 1977: Search Report under Section 17(6) dated Oct. 26, 2015.
The Extended European Search Report issued in corresponding European Application No. 19213106.8 dated Feb. 13, 2020.
First Chinese Office Action dated Aug. 2, 2019, issued in corresponding Chinese Application No. 201680012577.1, 22 pages (with English Translation).
Second Chinese Office Action dated Apr. 16, 2020 issued in corresponding Chinese Application No. 201680012577.1, 7 pages (with English Translation).
Office Action issued in corresponding Taiwanese Application No. 105106166 dated Apr. 23, 2020 (with English translation).
Japanese Office Action issued in Japanese Application No. 2019-162197 with English Translation dated Nov. 25, 2020.

* cited by examiner

LIGHT AND LOUDSPEAKER DRIVER DEVICE

CROSS-REFERENCE TO RELATED APPLICATIONS

This application is a continuation of U.S. patent application Ser. No. 15/553,914, filed Aug. 25, 2017, which is a National Stage of PCT/GB2016/050524, filed Feb. 29, 2016, which claims priority under 35 U.S.C. § 119 to GB Application No. 1503426.7, filed Feb. 27, 2015, all of which are incorporated herein by reference in their entirety.

FIELD OF THE INVENTION

The present invention relates to a light and loudspeaker driver device, and also to a system comprising a plurality of such devices.

BACKGROUND OF THE INVENTION

Loudspeaker drivers that can be flush-mounted within a wall or ceiling have been commercially available for many years. Such drivers have been developed to deliver high sound quality evenly throughout a room. The drivers have been designed to blend into the ceiling or wall, for example, by having paintable grilles. They are particularly applicable to home cinema systems but have also been developed to be water resistant and so can be mounted outside or in bathrooms. More recent variants have incorporated wireless capacity to permit transmission of audio information via a Bluetooth or 802.11 wireless network, for example. Nevertheless, installation of such loudspeaker drivers is a specialized and expensive task.

Traditional ceiling mounted room lighting employs an array of incandescent, halogen, fluorescent or, more recently, LED-based light sources. For example, an array of multi-faceted reflector light bulbs may be installed within a plurality of (usually circular) recesses in a ceiling, the lights being typically wired in series around a lighting ring either at 240V or at 12V with a transformer being provided in the ceiling void. One of the challenges of such arrangements is ensuring that the heat generated by the lights is not excessive.

As lights become more sophisticated, with LED technologies allowing different form factors and levels of adaption, controlling the light settings, ambience and mood demands increasingly sophisticated control, either through complex (perhaps retrofitted) wall fittings, smart phone apps, or dedicated portable remote lighting controls.

A further problem with the foregoing is that a ceiling can become cluttered and aesthetically unattractive when provided with a first array of loudspeaker drivers and a second array of lights. The ceiling void is also filled with a range of mains and lower voltage cables and connectors to service the array of audio and lighting units.

For example, US2007222631 describes a device having LEDs mounted around a periphery of a central loudspeaker driver. The driver comprises both a woofer and a plurality of tweeters. The tweeters are located in front of the woofer and are positionable outside of the fixture to improve the sound quality. The resultant device provides relatively poor illumination as well as compromised sound output with a complicated and inconvenient structure.

EP 2,498,512 A2 describes a speaker apparatus that includes a diaphragm formed in an annular shape, a light emitting member and a heat controlling member conducting heat generated when the light emitting member emits light to a heat radiating section. At least part of the heat controlling member is provided on an axis including the central axis of the diaphragm and the light emitting member is disposed on an end face of the heat controlling member.

The speaker apparatus has a base which is provided as the power supply input section. The speaker apparatus 1 can be easily supplied with power by inserting the base into a power supply connector provided on a wall or ceiling. In addition, the base eliminates the need for a holding section for holding the speaker apparatus 1 on a wall or ceiling, and the speaker apparatus 1 can therefore be made compact. In other words, the device can be fitted into existing power outlets for standard light bulbs.

Nevertheless, the various devices above all represent a compromise either in terms of the lighting, the sound, or both. The present invention seeks to address these problems with the prior art.

SUMMARY OF THE INVENTION

According to a first aspect of the present invention, a combined light and loudspeaker driver device is provided. The device comprises a loudspeaker driver having a loudspeaker diaphragm with an opening formed around a central longitudinal axis of the device. The central longitudinal axis defines a forward and a rearward direction of the device. The device also comprises a housing for supporting the loudspeaker driver, a light source positioned radially inwardly of the opening of the loudspeaker diaphragm, with respect to the central longitudinal axis and configured to direct light forward and away from the device and a heat removal element. The heat removal element comprises a heat sink having at least an axially central part formed rearwardly of the housing along the central longitudinal axis of the device, and a heat removal column extending from the axially central part of the heat sink in the forward direction along the central longitudinal axis of the device. The light source is mounted at the forward end of the heat removal column.

Advantageously, the present invention provides a heat removal column that extends rearwardly from the light source to the housing along a longitudinal axis and to an axially central part of the heat sink. Such a configuration enables heat generated by the light source to be efficiently conducted directly away to a part of the device that is remote from the source of the heat. The route that the heat takes from the light source to the heat sink is therefore more direct than configurations that conduct the heat sideways around other components. A more direct route increases the heat gradient along the heat removal element and allows for more efficient removal of heat from the device. By ensuring efficient removal of heat from the device, the device may operate more efficiently and higher power light sources may be used than would otherwise be appropriate in devices that do not remove heat so efficiently.

Moreover, by providing a heat removal column that extends along a longitudinal axis to an axially central part of the housing, the present invention provides a device containing an air gap behind the loudspeaker diaphragm. In other devices, components (such as heat removal elements) in the void behind the diaphragm impede the flow of air behind the loudspeaker diaphragm. In contrast, the present invention provides a heat removal column that extends rearwardly and therefore does not impede the flow of air behind the diaphragm. This may advantageously lead to improved sound quality.

Furthermore, the present invention provides improved illumination compared to prior art devices. This is at least partially because the LEDs are positioned in the center of the device in the present invention. Prior art devices that include LEDs disposed around the periphery of a loudspeaker do not produce light of sufficient quality. By providing the light source (for instance an LED or an array of LEDs) in the center of the device, the present invention provides a more focused light source that can be used for functional task lighting.

The void may be defined between the rear of the loudspeaker cone, a rear portion of the housing immediately adjacent to the axially central part of the heat sink and interior sidewalls of the housing that extend forward from the rear portion of the housing to a front portion of the housing, proximal to the loudspeaker diaphragm, wherein the sidewalls do not converge with the heat removal column in the rearward direction over a majority of the length of the device. In other words, the void formed by the housing does not get narrower in a rearward direction until towards the rear of the device. This provides a volume of air behind the loudspeaker that improves the quality of the sound produced by the device. In prior art devices, the housing is shaped so that the device can be fitted into standard fittings. This bulb shape, which narrows significantly immediately behind the loudspeaker driver, does not provide a significant air gap behind the diaphragm. The quality of the sound is therefore improved by devices shaped as described in this application, as compared to prior art devices.

The sidewalls may not converge with the heat removal column in the rearward direction until the rear portion of the housing that is immediately proximal to the axially central part of the heat sink.

The interior of the housing may have sidewalls that extend rearwardly from a front of the device parallel to the longitudinal axis. This configuration provides for improved sound quality by allowing air to flow behind the diaphragm.

The interior of the housing may provide an air gap that extends rearwardly parallel to the longitudinal axis from the diaphragm to the rear part of the housing. By providing an air gap that is directly behind the diaphragm, the sound quality of the device may be enhanced.

The heat sink may form the rearmost part of the housing. This allows heat to be dissipated directly from the part of the housing to which the heat removal column connects. The sides of the housing may also be part of the heat sink. Providing a heat sink that extends from the rear of the housing and down the sides of the housing increases the surface area of the heat sink and allows for improved heat dissipation.

The heat sink may comprise a first plurality of fins. Each fin may extend in the radial direction from the longitudinal axis. The heat sink may further comprise a second plurality of fins that extend along exterior sidewalls of the housing. The second plurality of fins may be thermally connected to the first plurality of fins.

The light source may be configured to direct light away from the loudspeaker diaphragm of the device. This reduces interaction between light from the light source and the moving diaphragm. If the light were to interact with the diaphragm (for example by casting a shadow of the diaphragm) then undesirable visual effects (sometimes called "flutter") might be produced when the diaphragm vibrates during operation of the loudspeaker. By configuring the light source to direct light away from the loudspeaker membrane, the present invention provides enhanced audio quality and enhanced light quality.

The problem of flutter was not identified in prior art devices. This may be because existing devices do not produce high quality sound and so the amplitude of the vibration of the diaphragm is relatively small. In contrast, the present invention provides enhanced audio output and therefore larger amplitude vibrations of the diaphragm are observed. The movement of shadows cast from the speaker diaphragm are therefore more noticeable in devices providing better quality audio output. Directing light away from the diaphragm enables the present invention to deliver enhanced audio quality, without compromising the quality of the light produced from the device.

The light source may be positioned forward of the opening of the loudspeaker diaphragm. By positioning the light source forward of the diaphragm, the present invention reduces interaction between light from the light source and the diaphragm. This helps to address the problem of flutter mentioned above.

The light source may be configured to provide functional illumination to a room. Functional illumination is illumination powerful enough to provide light to a significant part of a room such that persons in the room can see sufficiently to perform tasks. Some existing combined lighting and loudspeaker devices only provide decorative illumination, rather than functional illumination. This may explain why such devices did not have a need to remove heat from the device as only a small amount of heat is produced by low-powered decorative lighting. In contrast, the present invention advantageously provides functional illumination to a room as a replacement to standard lighting systems. The system may provide directed task lighting to specific areas or may provide diffuse general lighting to a wider area.

The light source may comprise one LED or a plurality of LEDs. The LED or LEDs may be blue or UV LEDs mounted so as to face toward a cover member that is coated with, impregnated with, or formed from, a phosphor material. The cover member may form an enclosure for the blue or UV LED(s). The external surface of the cover member may comprise a translucent, white coating. Advantageously, the coating masks the appearance of the phosphor material on the cover member, which may be a yellow colour.

The device may further comprise a lens or lens array mounted in front of the light source. Advantageously, a lens can be used to direct light to a particular area of the room and can adjust how diffuse or targeted the illumination provided by the device is.

The lens or lens array may be removably mounted in front of the light source. The lens or lens array may be magnetically or mechanically mounted in front of the light source. The lens or lens array may be used to adjust the direction and/or beam angle of the illumination from the light source.

The loudspeaker diaphragm may be connected to the housing by a flexible roll surround, the roll surround being shaped as an annulus with a convex rearward surface and a concave frontward surface. The roll surround vibrates when the diaphragm vibrates. This can contribute to the problem of flutter mentioned above. By providing a roll surround that is concave at the front, the forward protrusion of the vibrating parts is reduced. The problem of flutter may therefore also be reduced by providing an "inverted" roll-surround. This is in contrast to a roll-surround of a standard speaker, which typically protrudes forwards.

The loudspeaker diaphragm may be formed as an inverted cone or circular paraboloid. These shapes can further enhance the quality of the sound produced by the device. Moreover, by providing a diaphragm that has a flat or concave profile (that is, a profile that does not protrude forwards), interaction between the vibrating diaphragm and the light source is reduced. This can help to address the problem of flutter discussed above.

The device may further comprise a dome tweeter having a tweeter membrane in the form of a dome. The light source may be positioned behind the tweeter membrane. The tweeter membrane may be configured to receive light generated by the light source and to transmit or radiate the received light away from the device, particularly away from the loudspeaker diaphragm of the device.

Advantageously, the present invention therefore provides a compact device that contains a loudspeaker diaphragm for producing low-frequency sounds and a tweeter membrane for producing high-frequency sounds. The quality of the audio output may therefore be improved with such a device. By providing a tweeter membrane that is transparent, the light source may be placed behind the tweeter membrane to create a more compact device. Moreover, by positioning the components on the longitudinal axis of the device, removal of heat from the light source and the other components can be achieved effectively by the heat removal column.

The tweeter membrane may be transparent or translucent. The tweeter membrane may be formed of, coated with, or impregnated with a fluorescent or phosphorescent material adapted to receive light generated by the light source, absorb the received light and emit light away from the device. The LEDs may be blue or UV LEDs mounted so as to face toward the tweeter membrane. The external surface of the tweeter membrane may comprise a translucent, white coating.

The device may further comprise a ring radiator tweeter positioned radially inwardly of the opening in the loudspeaker diaphragm and radially outwardly of the light source, with respect to the longitudinal axis. Advantageously, the present invention therefore provides a compact device that contains a loudspeaker diaphragm for producing low-frequency sounds and a ring-radiator tweeter for producing high-frequency sounds. The quality of the audio output may therefore be improved with such a device. By providing a tweeter that is in the form of a ring, the light source may be placed in the center of the ring to create a more compact device. Moreover, by positioning the components on the longitudinal axis of the device, removal of heat from the light source and the other components can be achieved effectively by the heat removal column.

The device may further comprise a speaker grille mounted forward of a front surface of the loudspeaker diaphragm. The speaker grille may be either light diffusive and/or transparent/translucent. The speaker grille may comprise an aperture to allow egress of light from the light source away from the device. The speaker grille may have a plurality of reflective surfaces concentric with the aperture, each arranged to reflect light from the light source away from the device.

The device may further comprise a lens positioned in the aperture of the grille. The speaker grille may include optic fibers.

The device may further comprise one or more microphones, and a wireless transceiver configured to receive and transmit audio and electrical signals to control the light and sound.

Further embodiments are also provided in accordance with the present invention.

According to a further aspect of the present invention, there is provided a combined light and loudspeaker driver device comprising a light source and a loudspeaker driver having a loudspeaker diaphragm, wherein the light source is positioned radially inwardly of the loudspeaker diaphragm.

By locating the light source radially inwardly of the driver diaphragm, the amount of light that can be thrown forward of the device and into the room is improved (since the driver diaphragm does not sit between the light source and the room), whilst the sound output is also not compromised because the light source does not block the sound. In preferred embodiments, a heat removal element comprising a heat sink in thermal connection with the light source may be provided. The light source may be connected to the heat sink via a heat removal column, heat pipe or a thermally conductive grille. The heat removal element may increase the longevity of the device, reduce fire risks when the device is mounted in a wall or ceiling, and/or permit a high power light source to be employed (since the improved heat sinking permits a light source with a greater heat output to be employed).

The driver diaphragm may, for example, be a driver cone. However, to further enhance the audio experience the diaphragm may alternatively be inverted. This gives a wider dispersion to the high frequency sounds, which reduces 'pooling of sound' under each device.

In accordance with a further aspect of the present invention, there is provided a combined light and loudspeaker driver device comprising a light source and a loudspeaker driver having a loudspeaker diaphragm, wherein the light source is positioned behind the loudspeaker diaphragm so as to direct light through the loudspeaker diaphragm and away from the device, wherein the loudspeaker diaphragm is configured to receive light generated by the light source and to transmit or radiate the received light away from the device.

Here, the light source is positioned behind the driver diaphragm, so as to direct light through the driver diaphragm and away from the device. This is advantageous, not only because of conservation of space, but also because the driver diaphragm forms part of the light emission system. In preferred embodiments, the driver diaphragm can be coated with or formed from a fluorescent or phosphorescent material so that the driver diaphragm can interact with the light source and emit the received light away from the device. In an exemplary embodiment, the light source may be a blue or Ultra Violet (UV) LED and the driver diaphragm may be formed of, coated with or impregnated with phosphor.

The driver diaphragm in accordance with embodiments of this invention may form the cone of a woofer. Alternatively, the diaphragm may form a membrane of a tweeter.

In accordance with a further aspect of the present invention, there is provided a combined light and loudspeaker driver device comprising a light source and a loudspeaker driver having a speaker grille and loudspeaker diaphragm, the speaker grille being mounted in front of a front surface of the loudspeaker diaphragm, wherein the light source is mounted on the grille, and in that the grille is reflective so as to reflect light from the light source away from the combined light and loudspeaker driver device.

Here, the light source is mounted on a reflective speaker grille such that light is reflected from the light source away from the device. In a preferred embodiment, the speaker grille comprises a plurality of reflective surfaces on which a plurality of lighting elements are mounted so as to radiate light towards one or more of the reflective surfaces of the grille. This preferred embodiment maximizes the amount of light that can be thrown into the room.

The invention also extends to a system comprising a plurality of such combined light and loudspeaker driver devices, each being in wireless communication with a controller. The controller may in turn communicate wirelessly with an audio source such as a smart phone or MP3 player, or may be configured to receive digital or analogue radio content (DAB, FM, AM etc) or streamed music via an internet connection.

The devices of such a system may additionally or alternatively include one or more microphones to pick up verbal instructions from a system user. Such instructions may permit the user to switch on or off, or dim, individual ones, some or all of the light sources in the plurality of combined light and loudspeaker driver devices. The microphones may also permit the user to instruct audio to be played or stopped, the volume to be reduced or increased, the audio source to be changed (eg from a streamed music service to a specified DAB radio station) and so forth. Employing a plurality of microphones within the plurality of devices allows for noise cancelling and discrimination; for example spaced microphones may permit verbal instructions provided by a user to be distinguished by the system controller, from ambient/background noise and/or music/speech being emitted by the loudspeaker drivers of the system itself.

BRIEF DESCRIPTION OF THE DRAWINGS

The present invention may be put into practice in a number of ways, and some specific embodiments will now be described by way of example only and with reference to the following drawings in which.

DETAILED DESCRIPTION OF PREFERRED EMBODIMENTS

Figure 1:
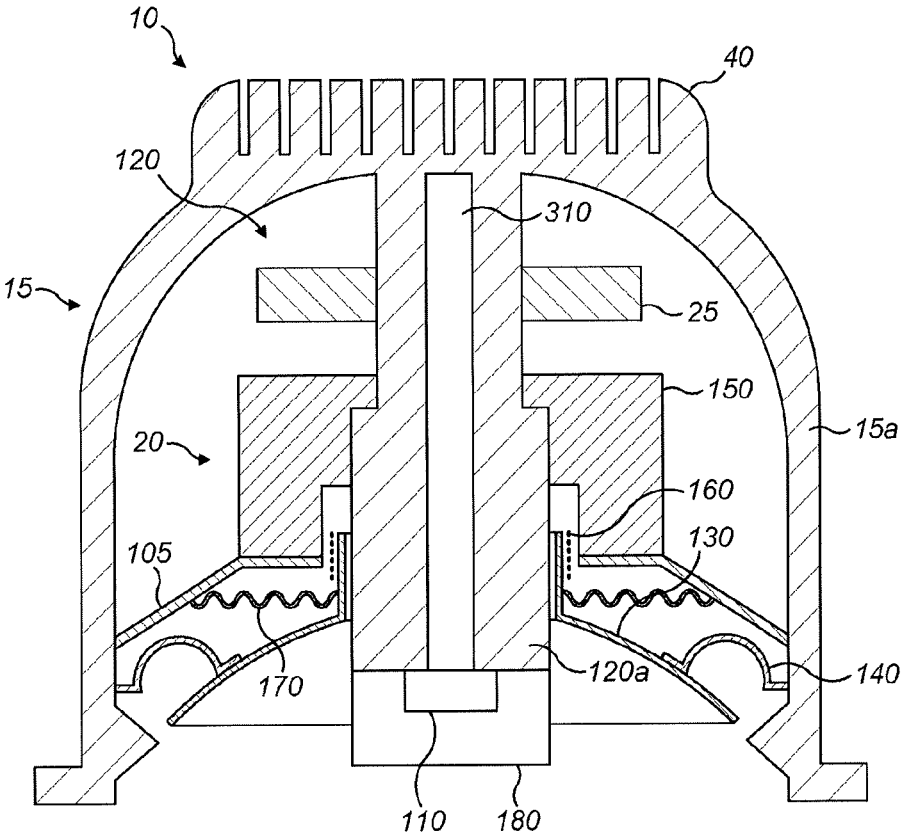
FIG. 1 shows a specific arrangement of a combined light and loudspeaker driver device in accordance with a first embodiment of the present invention.

FIG. 1 shows a combined light and loudspeaker driver device 10. The device 10 includes a housing 15 that supports a loudspeaker driver 20, a heat sink 40, electronic components 25 and a light source 110 on a heat removal element 120. In use, the housing 15 is employed to mount the device 10 within an aperture in a ceiling (not shown).

The loudspeaker driver 20 includes a diaphragm 130 with an opening formed around a central longitudinal axis of the device 10, the central longitudinal axis defining a forward and a rearward direction of the device 10. The diaphragm 130 moves axially to produce sound. The diaphragm 130 is mounted radially inwardly of a frustoconical basket 105 of the housing 15 that serves to support the diaphragm 130, and is connected at an outer periphery thereof to the basket 105 where the latter is affixed to sidewalls 15*a* of the housing 15, using a roll surround 140.

Rearwardly of the loudspeaker diaphragm (that is, further into the cavity in the ceiling not shown) is located a drive unit of the loudspeaker driver 20. The drive unit comprises a ring-shaped magnet 150 mounted on the frustoconical basket 105 and a voice coil 160, which is attached to the diaphragm 130 and positioned within the centre of the ring-shaped magnet 150. As will be understood, electrical signals supplied to the magnet 150 cause the voice coil 160 to move the diaphragm 130 and produce sound.

The loudspeaker driver 20 also includes a spider 170 that attaches the centre of the diaphragm 130 to the basket 105. The roll surround 140 and spider 170 together allow the diaphragm 130 to move axially when driven by the drive unit but keep the diaphragm 130, and hence voice coil 160, centred.

The heat removal element 120 of the combined light and loudspeaker driver device 10 is positioned radially inwardly of diaphragm 130 and coaxial with the central longitudinal axis of the combined light and loudspeaker driver device 10. The heat removal element 120 has a first, relatively high aspect ratio column portion 120*a* extending through the centre of the diaphragm 130. The column portion 120*a* of the heat removal element is in thermal connection with, the heat sink 40. The heat removal column 120*a* serves to conduct heat away from the combined light and loudspeaker driver device 10 to the heat sink 40 located in the aperture in the ceiling (not shown). Providing a heat removal column 120*a* that extends along a longitudinal axis to an axially central part of the housing 15 is advantageous, since the present invention provides a device containing a void behind the loudspeaker diaphragm 130. More specifically, the void is located between a rear portion of the housing 15 immediately adjacent to the axially central part of the heat sink 40, the rear of the loudspeaker diaphragm 130 and the sidewalls of the housing 15*a*. The void enables air to flow freely behind the diaphragm 130, which leads to improves sound quality.

The heat sink 40 is mounted behind the aperture in the ceiling (not shown) on a second side facing away from the ceiling aperture. The heat sink 40 serves to conduct heat received from the device 10 via the heat removal column 120*a* into the aperture in the ceiling. The heat sink 40 and the housing 15 may be formed as a single unit. Alternatively, the heat sink 40 may be formed separately and mounted onto the rear portion of the housing 15 by, for example, soldering or welding.

Mounted on an end of the heat removal column 120*a* is the light source 110. By providing the light source (for instance an LED or an array of LEDs) in the center of the device, a more focused light source is provided that can be used for functional task lighting. Light sources used for task lighting generate significant heat, which is advantageously removed by the heat sink 40. The light source 110 may be a single LED. Alternatively, a pair of LEDs or three LED close together in the form of a single LED unit may be used. Preferably a spot focusing lens 180 is mounted on the heat removal column so as to cover the light source. The lens 180 can be changed to give different light effects. The light source 110 is mounted upon a thermally conductive light fitting. The light source 110 and its light fitting are mounted on the central longitudinal axis of the device 10. The light source 110 is thermally connected to a heat pipe 310 that provides a thermal connection between the light source 110 and the heat sink 40, for efficient removal of heat from the device 10. The heat pipe may also support the light fitting of the light source 110.

The sidewalls 15*a* of the housing 15 do not converge with the heat removal column 120*a*, thereby providing a housing 15 which is in the form of a cup. This is advantageous, since is that the volume of the void formed between the rear of the loudspeaker diaphragm 30 and the housing 15 is maximised, which improves the quality of the sound produced by the device 10.

Figure 2:
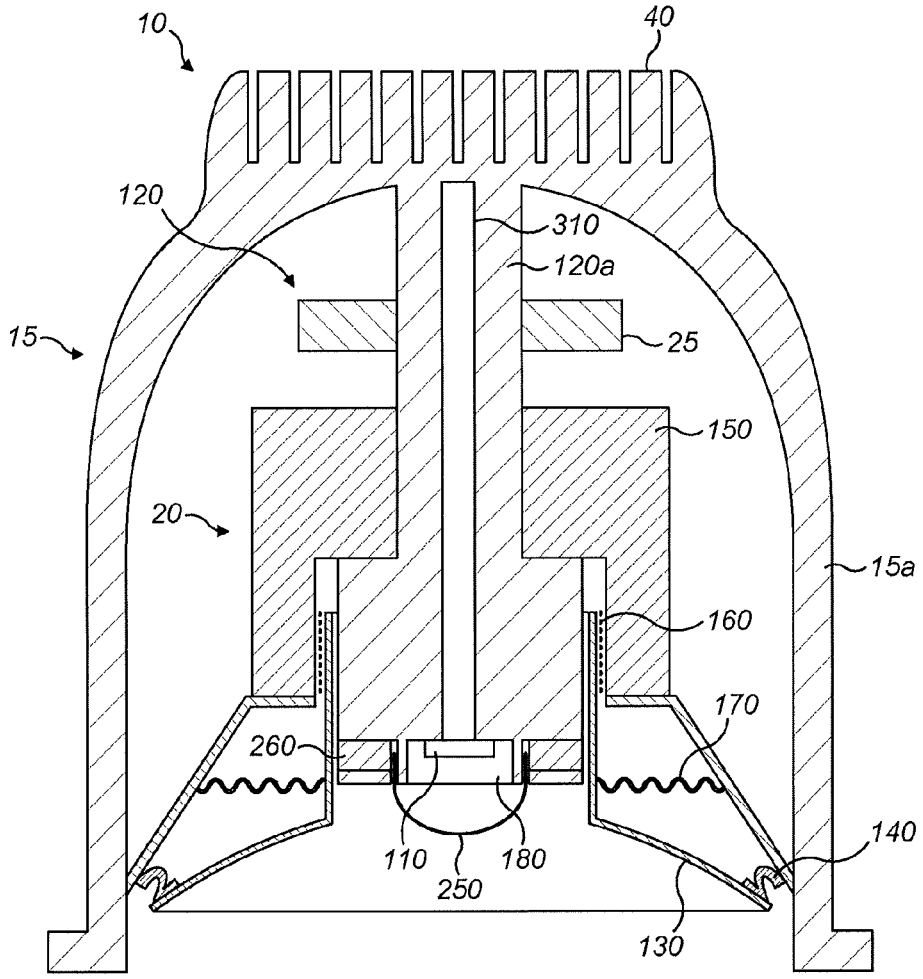
FIG. 2 shows a combined light and loudspeaker driver device in accordance with a second embodiment of the present invention.

FIG. 2 shows a detailed view of a combined light and loudspeaker driver device 10 in accordance with a further embodiment of the present invention. The arrangement of FIG. 2 is similar to that of FIG. 1. In FIG. 2, however, the combined light and loudspeaker driver device 10 includes a tweeter.

The tweeter is a dome tweeter and is supported by a housing that is also used to mount the tweeter onto the heat removal column 120*a*. The tweeter includes a tweeter membrane in the form of a dome 250 that moves axially to produce sound of a relatively high frequency. Rearwardly and radially inwardly of the tweeter membrane 250 is located a drive unit of the tweeter.

The drive unit includes a tweeter ring-shaped magnet 260 that is supported by the housing and mounted on the heat removal column 120*a*. The drive unit also includes a tweeter voice coil that is attached to the tweeter membrane 250 and positioned between the tweeter membrane 250 and the outer periphery of the tweeter ring-shaped magnet 260. As will be understood, electrical signals supplied to the magnet 260 cause the voice coil to move the tweeter membrane 250 and produce sound.

Figure 3:
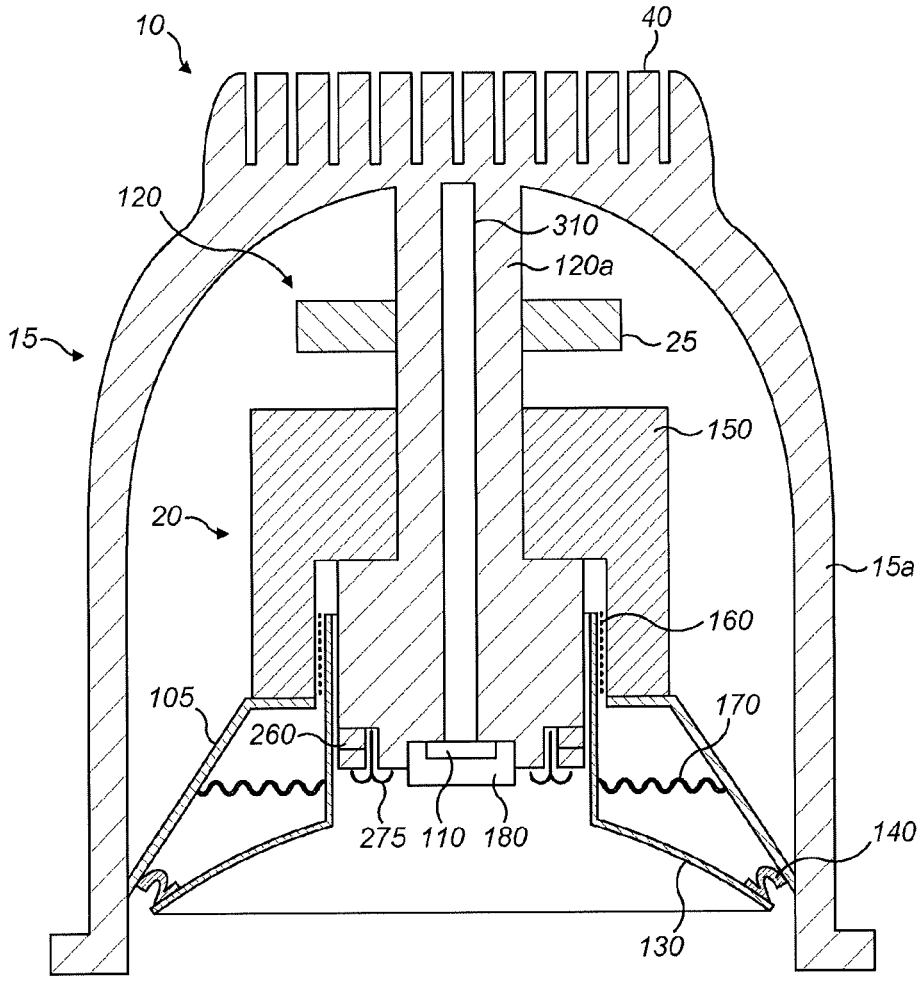
FIG. 3 shows a combined light and loudspeaker driver device in accordance with a third embodiment of the present invention.

FIG. 3 shows a detailed view of a combined light and loudspeaker driver device 10. The arrangement of FIG. 3 is similar to that of FIG. 2. In FIG. 3, however, the tweeter is a ring radiator tweeter.

The tweeter is a ring radiator tweeter and, hence, ring-shaped. Supporting the tweeter is a housing that is also used to mount the tweeter on the distal end of the heat removal column 120*a*. More specifically, the tweeter is recessed into the distal end of the heat removal column 120*a*. The light source 110 and lens 180 covering the light source 110 are also mounted on and recessed into the distal end of the heat removal column 120. The light source 110 and lens 180 covering the light source are positioned within the centre of the ring-shaped tweeter.

The tweeter comprises a bi-annular membrane 275 that moves axially to produce high frequency sound. An outer annulus of the membrane 275 is attached to an outer periphery of the distal end of the heat removal column 120*a* and an inner annulus of the membrane 275 is attached to the housing surrounding the light source 110 and lens 180. Rearwardly of the membrane 275 is located a drive unit of the tweeter.

The drive unit includes a tweeter ring-shaped magnet 260 that is supported by the housing and mounted on and recessed into the distal end of the heat removal column 120*a*. The drive unit also includes a tweeter voice coil, which is attached to the tweeter membrane 275 between the inner and outer annulus, and positioned between the membrane 275 and the outer periphery of the tweeter ring-shaped magnet 260. As will be understood, electrical signals supplied to the magnet 260 cause the voice coil to move the membrane 275 and produce sound.

Figure 4:
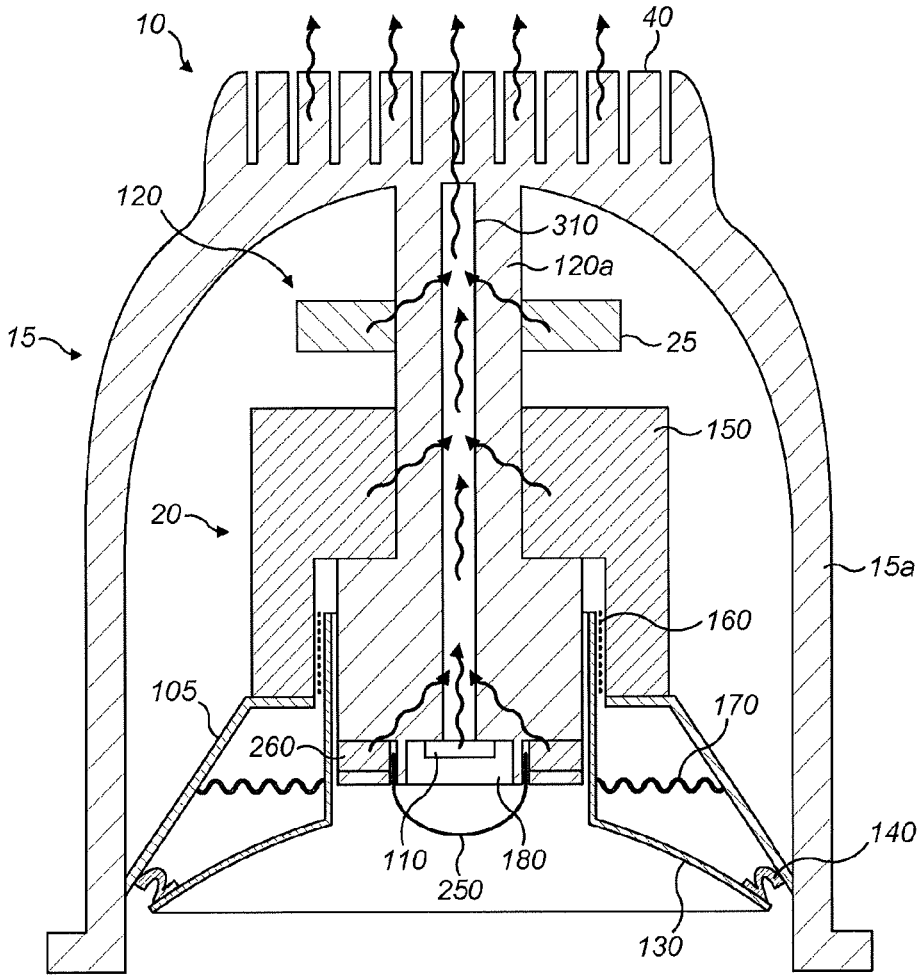
FIG. 4 shows how heat flows through a combined light and loudspeaker driver device in accordance with the present invention.

FIG. 4 shows how heat that is generated by the components in a combined light and loudspeaker device flows through the device. Heat may be generated by the light source 110, the tweeter magnet 260, the loudspeaker magnet 150 and the electronic components 25. Heat is then conducted through the heat pipe 310 to the heat sink 40.

Figure 5A:
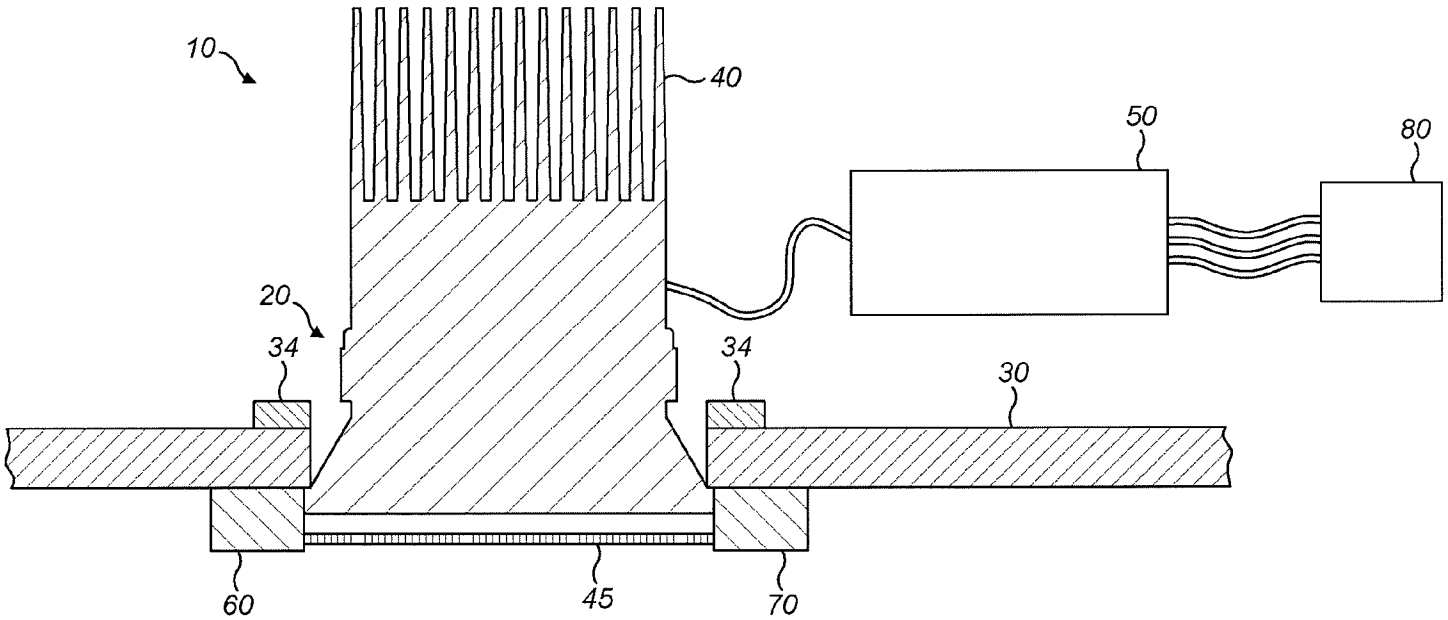
FIG. 5*a* shows a combined light and loudspeaker driver device embodying aspects of the present invention, in schematic form, mounted within a ceiling void along with a device controller/driver.

FIG. 5*a* shows a schematic diagram of a combined light and loudspeaker driver device 10 embodying the present invention. The combined light and loudspeaker driver device 10 comprises a loudspeaker driver 20 positioned within an aperture formed in a ceiling 30 such that the device 10 is sub-flush with the ceiling 30. The loudspeaker driver 20 is securely mounted to the ceiling 30 via a fixing 34. The fixing 34 can be damped to prevent vibration transmission to the ceiling 30. The fixing 34 can also be made of an intumescent material to serve as a fire barrier.

The loudspeaker driver 20 includes a light source and a loudspeaker, which are not visible in FIG. 5*a*. Mounted on the loudspeaker driver 20, in a cavity behind the ceiling 30, is a heat sink 40 for removal of heat from the device. Optionally mounted in front of a front surface of the loudspeaker driver is a speaker grille 45.

A control box 50 is electrically connected to the loudspeaker driver 20 and comprises electronic components used to control the device 10. The control box 50 is preferably mains powered and is placed in the cavity behind the ceiling 30 and connected to the loudspeaker driver 20 via a wire. Having the control box 50 removed from the loudspeaker driver 20 provides an easier arrangement for servicing. Alternatively, the control box 50 may be mounted directly onto the loudspeaker driver 20 or the heat sink 40.

A first and second transceiver 60, 70 are mounted adjacent the aperture and on the ceiling 30 on the side facing into the room of which the ceiling 30 is a part. Each transceiver 60, 70 includes one or more microphones, which picks up verbal commands. These commands are provided from each transceiver 60, 70 to the control box 50. Each transceiver 60, 70 is connected to the control box 50 via cable harness although they could, of course, be connected to the control box 50 wirelessly. The control box 50 includes a processor and an amplifier that are used in combination to control the combined light and loudspeaker driver device. The commands received by the control box 50 are digitalized and processed using the processor of the control box 50 to provide instructions to the amplifier to control the combined light and loudspeaker driver device 10. This allows, for example, the user to instruct the light source of the device to turn on or instruct the device to play certain music. Each transceiver also includes a wireless transmitter/receiver (for example, a WiFi or Bluetooth transmitter/receiver). The purpose of this is to enable the user to control the device remotely, for example, via a smart phone or tablet.

A switch 80 is electrically connected to the control box 50 and can be used to turn on/off the loudspeaker driver 20. The switch 80 comprises a switch plate. The switch plate is wifi connected as it comprises a wifi transmitter/receiver. This wifi transmitter/receiver can either be on the outside of the switch plate or in-line behind the switch plate. Furthermore, the wifi transmitter/receiver, although most conveniently positioned or located on or in the switch 80, could be located elsewhere—for example, as a separate unit within the ceiling void, formed as a part of the control box 50, and so forth. The switch 80 enables the user to turn on/off the light source 110 without affecting the loudspeaker driver 20 and visa versa. This is explained in more detail below. The wifi transmitter/receiver also enables the user to stream music to the device 10 wirelessly. As the control box 50, light source 110 and loudspeaker driver 20 of the combined light and loudspeaker driver device 10 are continuously powered, almost any wired power line protocol (PLC, X10 etc) and/or wireless protocol (BLE, Bluetooth EDR, WiFi, ZigBee, Z-Wave, 6LowPan etc) can be used to connect the switch 80 to the combined light and loudspeaker driver device 10.

Figure 5B:
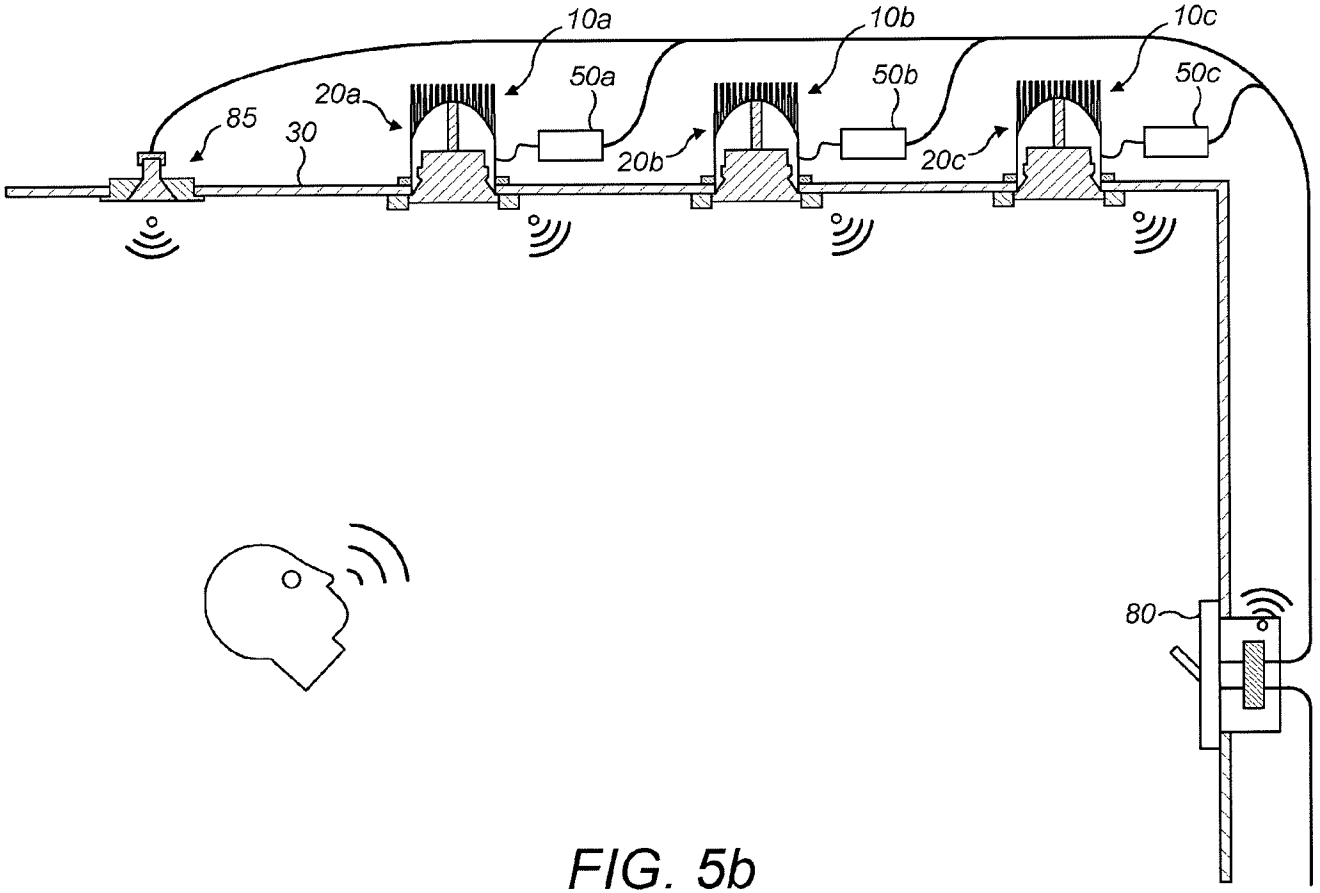
FIG. 5*b* shows a system, in schematic form, including three of the combined light and loudspeaker driver devices of FIG. 1*a* and a light bulb that includes a wifi transmitter/receiver (smartbulb)

FIG. 5*b* shows a system comprising three combined light and loudspeaker driver devices 10*a*, 10*b*, 10*c* of FIG. 5*a* and a light bulb that comprises a wifi transmitter/receiver (smartbulb 85). Each of the control boxes 50*a*, 50*b*, 50*c* of the devices 10*a*, 10*b*, 10*c* and the smartbulb 85 are electronically connected via the same circuit to switch 80. The switch 80 is similar to that of FIG. 5*a*. This enables the light source 110 of each device 10*a*, 10*b*, 10*c* and the smartbulb 85 to be switched on/off by the switch 80 without affecting the loudspeaker driver 20*a*, 20*b*, 20*c* of the devices 10*a*, 10*b*, 10*c*. The switch 80 can also be rewired such that it does not interrupt the power supplied to the light source 110 of each device 10*a*, 10*b*, 10*c* and the smartbulb 85. The wireless transmitter/receiver can be configured to digitally sense the switch state so as to control the loudspeaker drivers 20*a*, 20*b*, 20*c* of the combined light and loudspeaker driver devices 10*a*, 10*b*, 10*c*. Thus, the switch function is translated from a physical to logical circuit.

Figure 6:
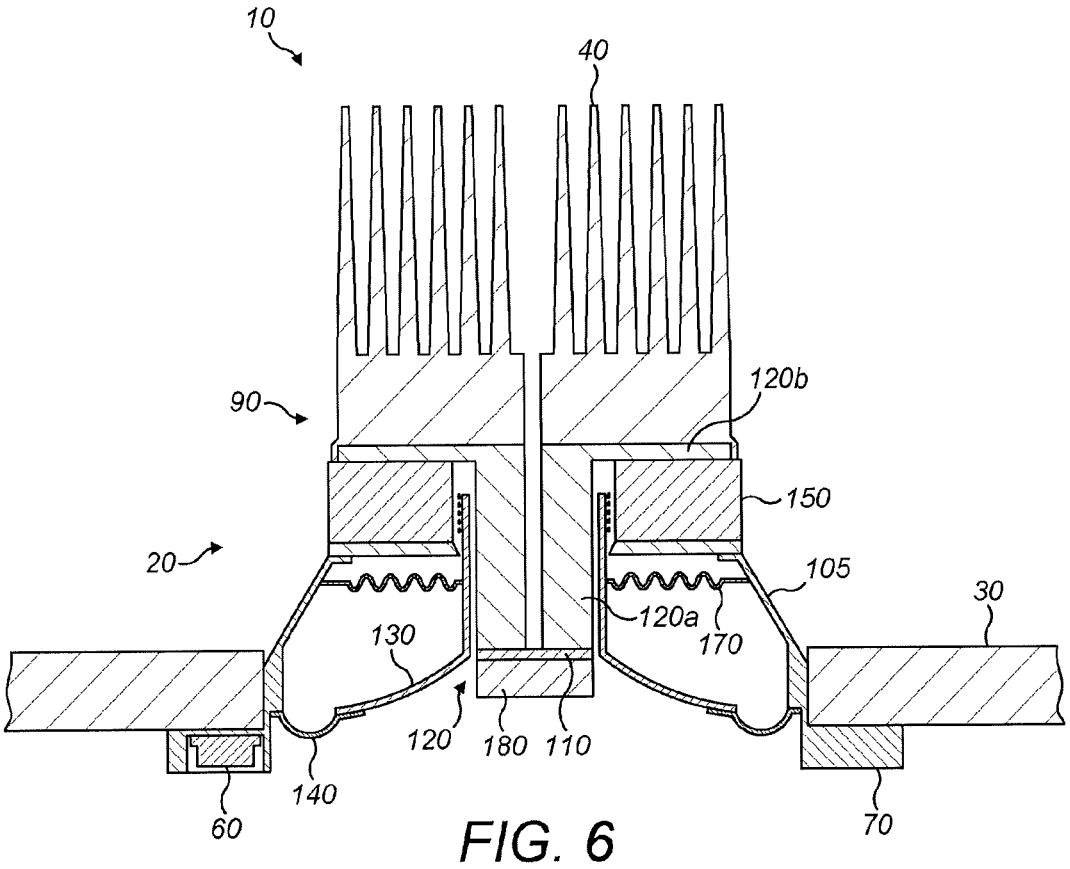
FIG. 6 shows a more specific arrangement of a combined light and loudspeaker driver device in accordance with a specific embodiment of the present invention.

FIG. 6 shows a more detailed view of a combined light and loudspeaker driver device 10. The device 10 includes a housing 90 that is, in FIG. 6, in the form of a frustoconical basket 105 that supports the loudspeaker driver 20, the heat sink 40, and a light source 110 on a heat removal element 120. In use, the housing 90 is employed to mount the device 10 within an aperture in the ceiling 30.

The loudspeaker driver 20 includes a diaphragm 130 that moves axially to produce sound. The diaphragm 130 is mounted radially inwardly of the basket 105 of the housing 90 that serves to support the diaphragm 130, and is connected at an outer periphery thereof to the basket 105 where the latter is affixed to the ceiling void, using a roll surround 140.

Rearwardly of the loudspeaker diaphragm (that is, further into the cavity in the ceiling 30) is located a drive unit of the loudspeaker driver 20. The drive unit comprises a ring-shaped magnet 150 mounted on the housing 90 and a voice coil 160, which is attached to the diaphragm 130 and positioned within the centre of the ring-shaped magnet 150. As will be understood, electrical signals supplied to the magnet 150 cause the voice coil 160 to move the diaphragm 130 and produce sound.

The loudspeaker driver 20 also includes a spider 170 that attaches the centre of the diaphragm 100 to the basket 105. The roll surround 140 and spider 170 together allow the diaphragm 130 to move axially when driven by the drive unit but keep the diaphragm 130, and hence voice coil 160, centred.

The heat removal element 120 of the combined light and loudspeaker driver device 10 is positioned radially inwardly of diaphragm 130 and coaxial with a central axis of the combined light and loudspeaker driver device 10. The heat removal element 120 has a first, relatively high aspect ratio column portion 120*a* extending through the centre of the diaphragm 130 and a second, relatively low aspect ratio base portion 120*b* rearwardly of the column portion 120*a*. The base portion 120*b* of the heat removal element mounts and supports the ring-shaped magnet 150 of the drive unit on a first side facing towards the ceiling aperture, and supports, and is in thermal connection with, the heat sink 40 on a second side facing away from the ceiling aperture. The heat removal element 120 serves to remove heat from the combined light and loudspeaker driver device 10.

Mounted on an end of the column portion 120*a* of the heat removal element 120 distal from the base portion 120*b* is the light source 110. In the embodiment of FIG. 6, the light source 110 is optionally a pair of LEDs and preferably a spot focusing lens 180 is mounted on the heat removal column so as to cover the light source. The lens 180 can be changed to give different light effects.

The heat removal column 120*a* is preferably mechanically decoupled from the diaphragm 130 to reduce/minimize movement of the light source 160 as the diaphragm 130 moves.

The combined light and loudspeaker driver device 10 is also provided with first and second transceivers 60 and 70. Each is mounted, as shown in FIG. 6, on the ceiling 30, adjacent to the device 10 when mounted. The transceivers are directed into the room of which the ceiling 30 is a part. Each transceiver 60, 70 includes one or more microphones which pick up verbal commands. These commands are received by the control box 50 (FIG. 5) and a processor in the control box 50 then digitises and processes/recognises the received verbal commands. The result of this processing is the generation of instructions to the combined light and loudspeaker driver device. Such instructions may, for example, be an instruction from the user to turn on or off the light source 110 of the device 10, or an instruction to the device 10 to play certain music. Each transceiver 60, 70 also includes a wifi and/or Bluetooth transmitter/receiver. The purpose of this is to enable the user to control the device 10 remotely, for example, via a smart phone or tablet, to stream music to the device 10 wirelessly, and so forth.

Figure 7:
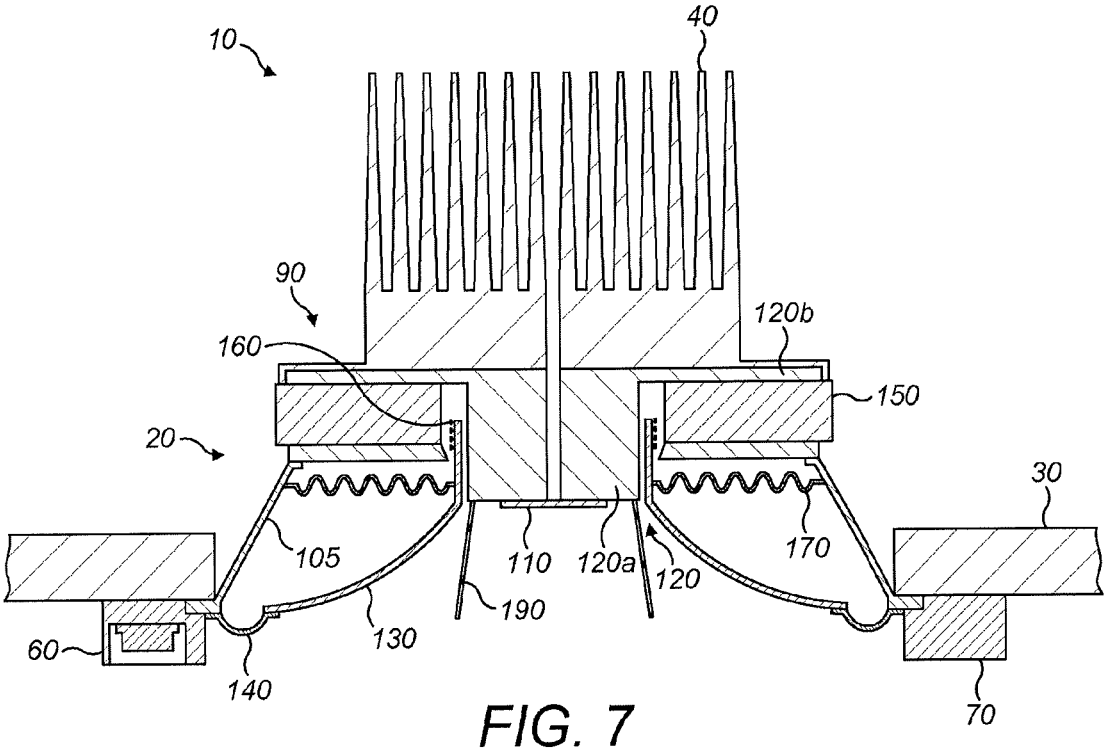
FIG. 7 shows a combined light and loudspeaker driver device in accordance with a further specific embodiment of the present invention.

FIG. 7 shows a detailed view of a combined light and loudspeaker driver device 10 in accordance with another specific embodiment of the present invention. The arrangement of FIG. 7 is essentially similar to that of FIG. 6 and so will not be described in detail to avoid repetition.

The difference between the arrangement of FIG. 6 and FIG. 7 is that, in FIG. 7, the combined light and loudspeaker driver device 10 optionally comprises an antiglare shroud 190 mounted on the distal end of the heat removal column 120*a* (that is, the end of the heat removal column distal from the heat sink 40), rather than a lens. The antiglare shroud 190 serves to improve the efficiency of light emission of the device. The antiglare shroud 190 does not hinder movement of the diaphragm 130 and so does not interfere with sound emission of the combined light and loudspeaker driver device 10.

Figure 8:
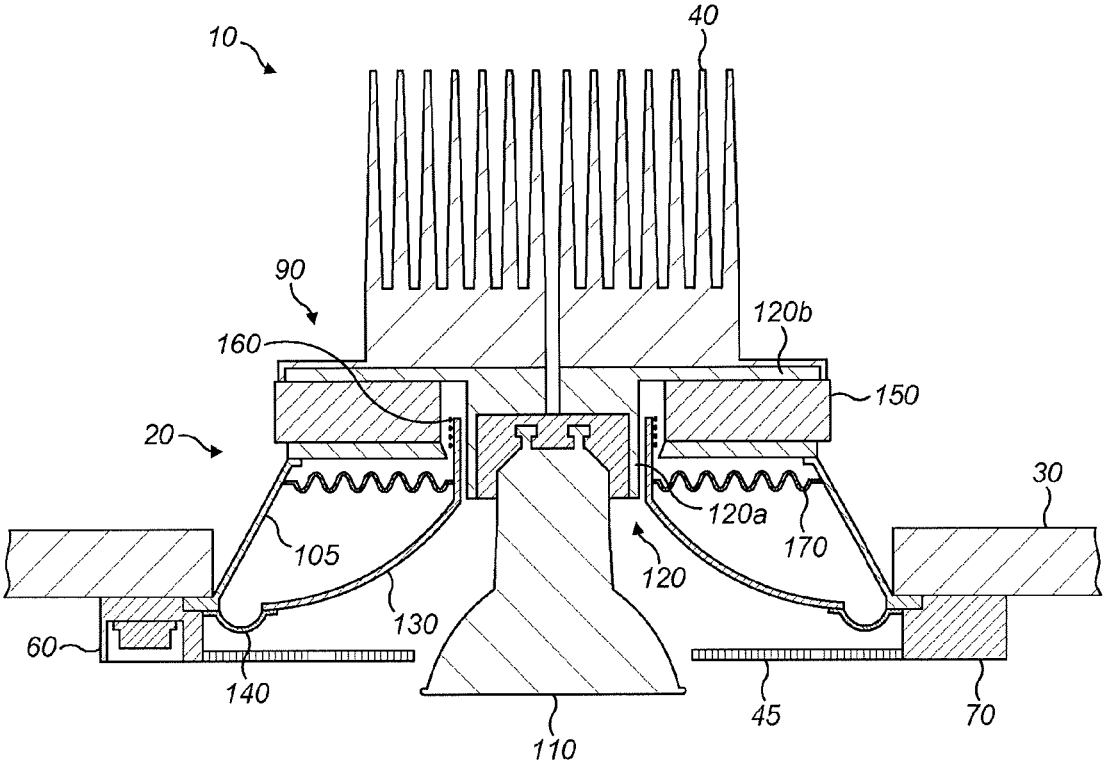
FIG. 8 shows a combined light and loudspeaker driver device in accordance with a further specific embodiment of the present invention.

FIG. 8 shows a detailed view of a combined light and loudspeaker driver device 10 in accordance with a further embodiment of the present invention. The arrangement of FIG. 8 is likewise similar to that of FIG. 6 and so again will not be described in detail. The difference between the arrangement of FIG. 6 and FIG. 8 is that, in FIG. 8, the light source 110 is optionally an incandescent light bulb. The incandescent light bulb is recessed into the end of the heat removal column 120*a* that is distal from the heat sink 40, and is positioned such that light is directed away from the device 10. The incandescent light bulb is recessed into the heat removal column 120*a* to prevent the incandescent light bulb from interfering with the movement of the diaphragm 130. In this manner, the incandescent light bulb does not interfere with sound emission of the combined light and loudspeaker driver device 10.

The combined light and loudspeaker driver device 10 also optionally comprises a speaker grille 45 mounted in front of a front surface of the loudspeaker driver 20 between transceiver 60 and transceiver 70. The speaker grille 45 is sound diffusive and comprises an aperture through which the incandescent light bulb extends. Hence, light emission from the incandescent light bulb is unaffected by the speaker grille 45.

Figure 9:
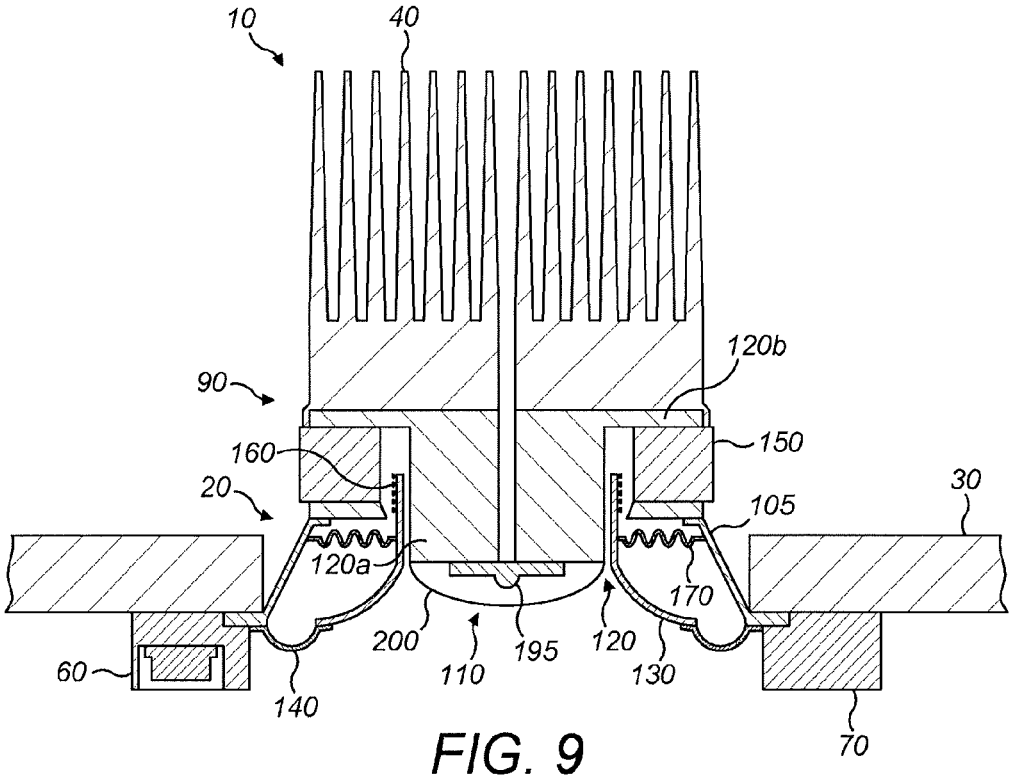
FIG. 9 shows a combined light and loudspeaker driver device in accordance with a further specific embodiment of the present invention.

FIG. 9 shows a detailed view of a combined light and loudspeaker driver device 10 in accordance with a further embodiment of the present invention. Again the arrangement of FIG. 9 is similar to that of FIG. 6. The difference between the arrangement of FIG. 6 and FIG. 9 is that, in FIG. 9, the device 10 does not comprise a lens over the light source 110 and that the light source 110 is a remote phosphor element.

The remote phosphor element comprises a blue or Ultra Violet (UV) LED 195 covered by a cover member 200 that is either transparent with a coating or impregnation of a phosphor material or is formed from a phosphor material. Light from the blue or UV LED 195 excites the phosphor material of the cover member 200 such that the phosphor material emits diffuse white light. Both the blue or UV LED 195 and the cover member 200 are mounted on the distal end of the heat removal column 120*a* (that is, the end of the heat removal column distal from the heat sink 40) such that the blue or UV LED 195 is directed towards the cover member 200. The cover member 200 is preferably dome shaped.

Figure 10:
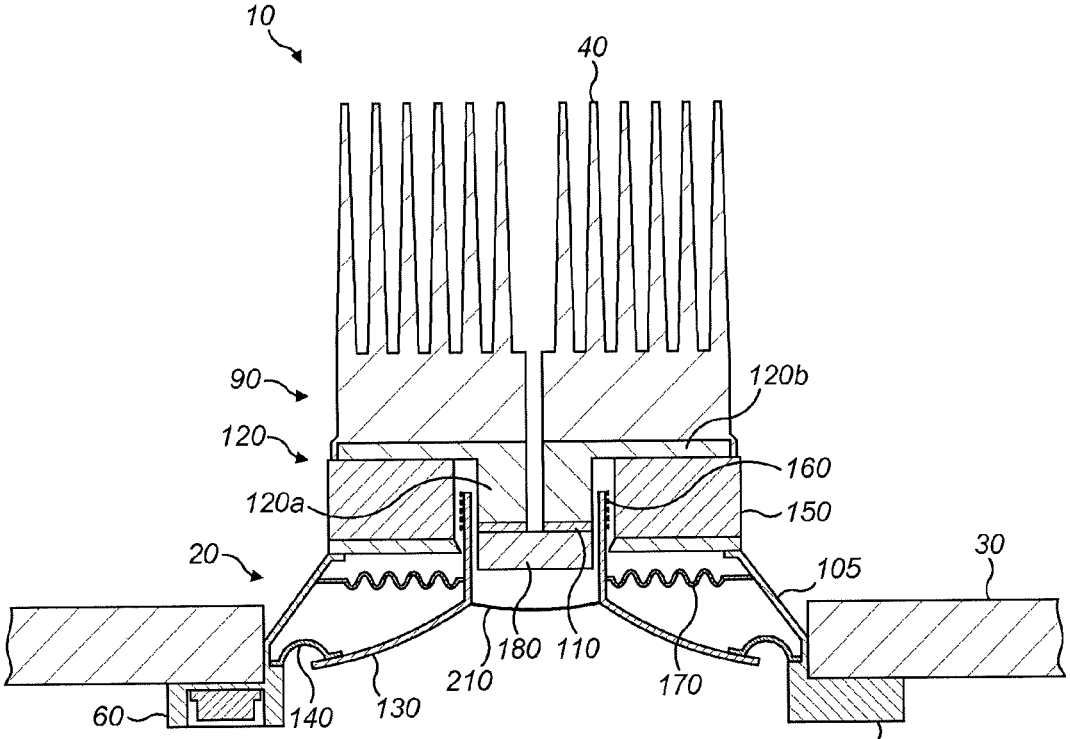
FIG. 10 shows a combined light and loudspeaker driver device in accordance with a further specific embodiment of the present invention.

FIG. 10 shows a detailed view of a combined light and loudspeaker driver device 10 in accordance with a further embodiment of the present invention. The arrangement of FIG. 10 is again similar to that of FIG. 6. However, in FIG. 10, the heat removal column 120*a* is of a lower aspect ratio than in the arrangement of FIG. 6, such that the end of the column 120*a* distal from the heat sink 40 is positioned within the central aperture in the diaphragm.

In FIG. 10, the combined light and loudspeaker driver device 10 also comprises a dust cap 210 that is attached to the diaphragm 130 and positioned in front of the light source 110 and lens 180 so as to cover the central aperture of the diaphragm 130. The dust cap 210 can move freely with the diaphragm 130 and prevents dust from passing between the rear and the front of the diaphragm 130. To prevent the dust cap from interfering with light emission of the combined light and loudspeaker driver device, the dust cap is made of a translucent or transparent material.

Figure 11:
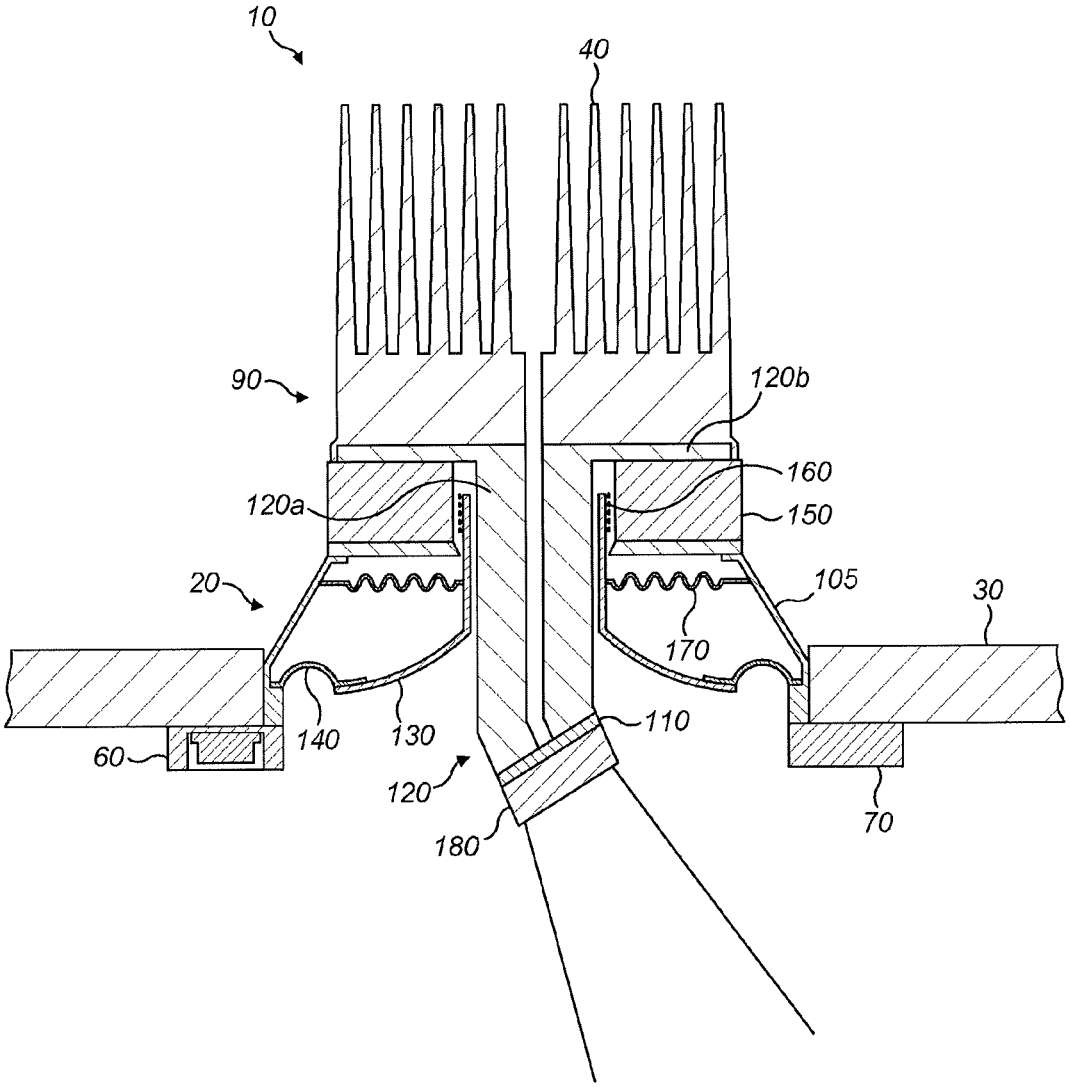
FIG. 11 shows a combined light and loudspeaker driver device in accordance with a further specific embodiment of the present invention.

FIG. 11 shows a detailed view of a combined light and loudspeaker driver device 10 in accordance with a further embodiment of the present invention. The arrangement of FIG. 11 is once again similar to that of FIG. 6. In FIG. 11 however, and in contrast to FIG. 6, the light source 110, mounted at the distal end of the heat removal column 120*a*, is moveable relative to the base portion 120*b* of the heat removal element 120. In particular, the light source is pivotally mounted or gimballed about the distal end of the heat removal column 120*a* so that the direction of emitted light can be adjusted. In a simple embodiment, the light source 110 may be manually adjusted by manipulating the light source relative to the remainder of the device 10.

More complex arrangements may include a linear or other drive motor that can be controlled by the control box 50, for example, in response to verbal commands from a user that are picked up by the microphones in the transceivers 60,70, or via a WiFi signal from a device operated by a user (which again may be picked up, this time the WiFi receivers in the transceivers 60, 70) or via a modified light switch on the wall of a room, and so forth.

Figure 12:
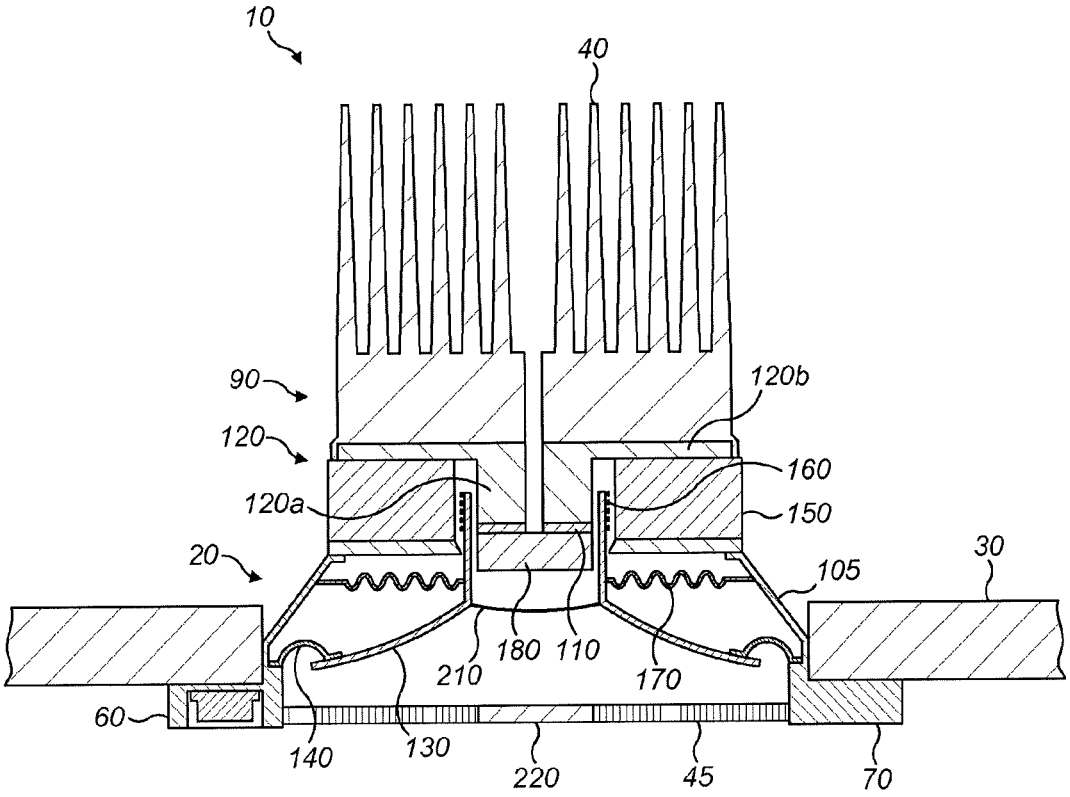
FIG. 12 shows a combined light and loudspeaker driver device in accordance with a further specific embodiment of the present invention.

FIG. 12 shows a detailed view of a combined light and loudspeaker driver device 10 in accordance with an further embodiment of the present invention. The arrangement of FIG. 12 is similar to that of FIG. 6, save that in FIG. 12 the combined light and loudspeaker driver device 10 comprises a speaker grille 45 mounted in front of a front surface of the loudspeaker driver 20.

The speaker grille 45 is sound diffusive and comprises a central aperture that is coaxial with the light source 110. In the central aperture, a secondary lens 220 is mounted. The secondary lens 220 is supported by the speaker grille 45 and serves to alter the quality of the light emitted from the combined light and loudspeaker driver device 10.

Also in FIG. 12, similarly to FIG. 10, the heat removal column 120*a* is of a lower aspect ratio and a dust cap 210 is attached to the diaphragm 130 and positioned in front of the of light source 110 and lens 180 so as to cover the central aperture of the diaphragm 130. Again, the dust cap 210 prevents dust from passing between the rear and the front of the diaphragm 130. The dust cap 210 is either transparent or translucent so that it does not affect light emission of the combined light and loudspeaker driver device 10. The dust cap 210 can move freely with the diaphragm 130 so that it does not affect the sound emission of the combined light and loudspeaker driver device 10.

Figure 13:
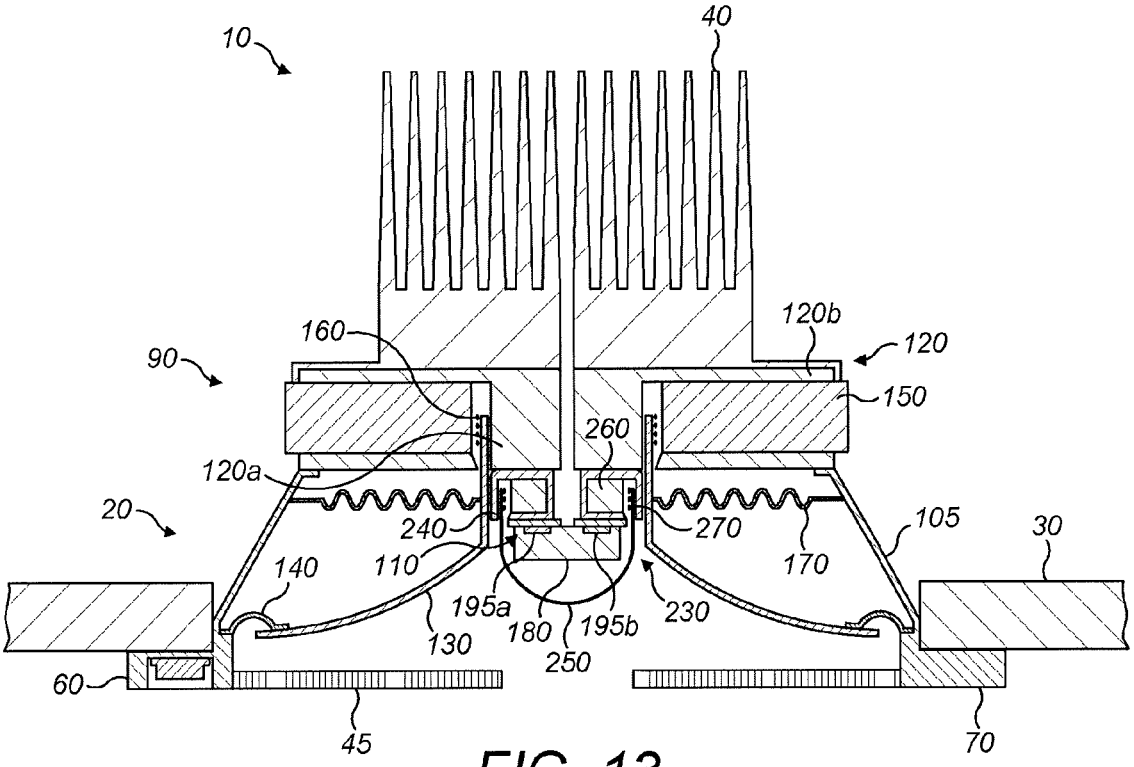
FIG. 13 shows a combined light and loudspeaker driver device in accordance with a further specific embodiment of the present invention.

FIG. 13 shows a detailed view of a combined light and loudspeaker driver device 10 in accordance with a further embodiment of the present invention. The arrangement of FIG. 13 is yet again similar to that of FIG. 6. In FIG. 13, however, the combined light and loudspeaker driver device 10 includes a tweeter 230.

The tweeter 230 is used to produce high frequency sounds. The tweeter is integrated with the light source 110 such that both are mounted on the end of the heat removal column that is distal from the heat sink and face into the room of which the device 10 is a part. The column 120*a* is of a lower aspect ratio to ensure that it remains discreet.

The tweeter 230 is, optionally, a dome tweeter and is supported by a housing 240 that is also used to mount the tweeter 230 onto the heat removal column 120*a*. The tweeter 230 includes a tweeter membrane in the form of a dome 250 that moves axially to produce sound of a relatively high frequency. Rearwardly and radially inwardly of the tweeter membrane 250 is located a drive unit of the tweeter 230.

The drive unit includes a tweeter ring-shaped magnet 260 that is supported by the housing 240 and mounted on the heat removal column 120*a*. The drive unit also includes a tweeter voice coil 270 that is attached to the tweeter membrane 250 and positioned between the tweeter membrane 250 and the outer periphery of the tweeter ring-shaped magnet 260. As will be understood, electrical signals supplied to the magnet 260 cause the voice coil 270 to move the tweeter membrane 250 and produce sound.

The light source 110, which is preferably two LEDs 195*a*, 195*b*, and the lens 180 covering the light source, are mounted on the ring-shaped magnet 260 and covered by the tweeter membrane 250. The LEDs 195*a*, 195*b* are mounted such that light is directed away from the combined light and loudspeaker driver device 10. In this preferred embodiment, each LED 195*a*, 195*b* is mounted on either side of the aperture of the ring-shaped magnet.

The tweeter membrane 250 is either transparent or translucent so that it does not affect light emission of the combined light and loudspeaker driver device 10. The magnet 260 remains stationary when the loudspeaker is in use. As a result, mounting the light source 110 on the magnet 260 does not affect the movement of the diaphragm 130 or of the tweeter membrane 250. Central positioning also ensures that the tweeter and light are positioned so as to optimize both light and sound emission. By providing the light source within the tweeter membrane, the device remains compact and discreet.

Figure 14:
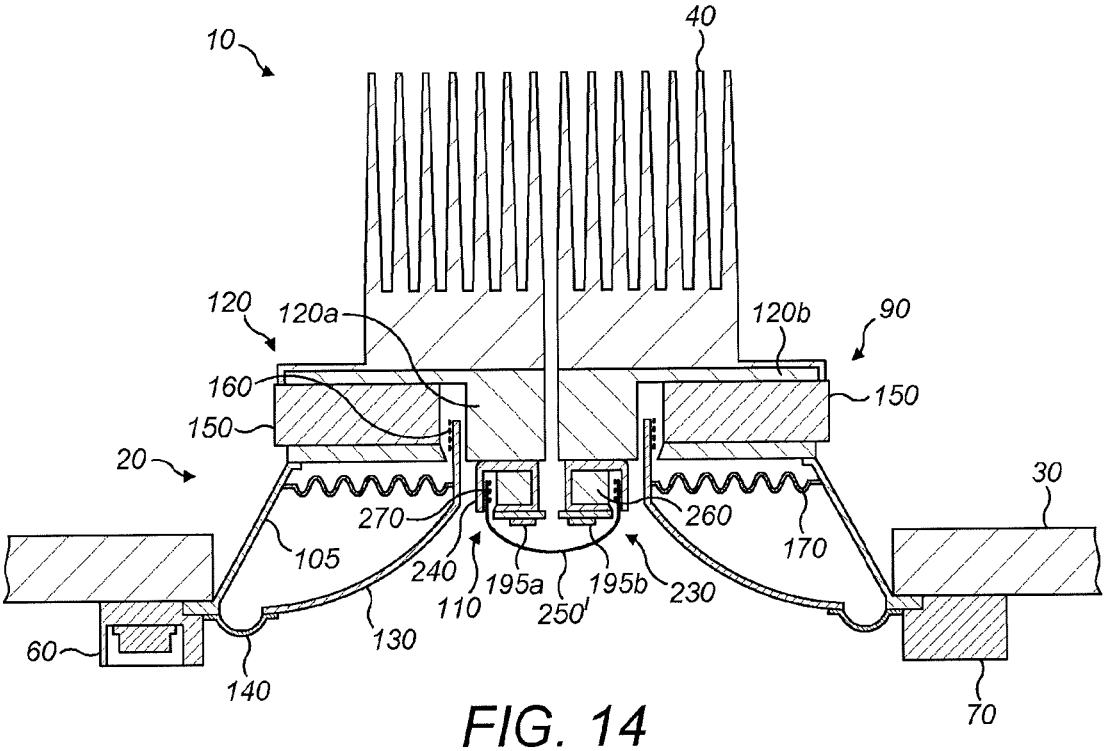
FIG. 14 shows a combined light and loudspeaker driver device in accordance with a further specific embodiment of the present invention.

FIG. 14 shows a detailed view of a combined light and loudspeaker driver device 10 in accordance with a further embodiment of the present invention. The arrangement of FIG. 14 is similar to that of FIG. 14 as both comprise a tweeter 230 that is integrated with the light source 110.

In FIG. 14, however, the light source 110 is not covered by a separate lens 180. Instead, the light source is covered by a tweeter membrane 250'. The tweeter membrane 250' of FIG. 14 has a dual purpose: it acts both so as to form a part of the light emission system and also as a part of the tweeter.

In particular, the tweeter membrane 250' of FIG. 14 is itself either transparent or translucent, with a coating or impregnation of a phosphor material, or is formed from a phosphor material. The light source preferably includes two blue or Ultraviolet (UV) LEDs 195*a*, 195*b*. Light from the blue or UV LEDs 195*a*, 195*b* excites the phosphor material of the tweeter membrane 250' such that white light is emitted.

Again, by providing both the tweeter 230 and light source 110 centrally of the combined light and loudspeaker driver device 10, emission of light and sound is improved and the device remains compact.

Figure 15:
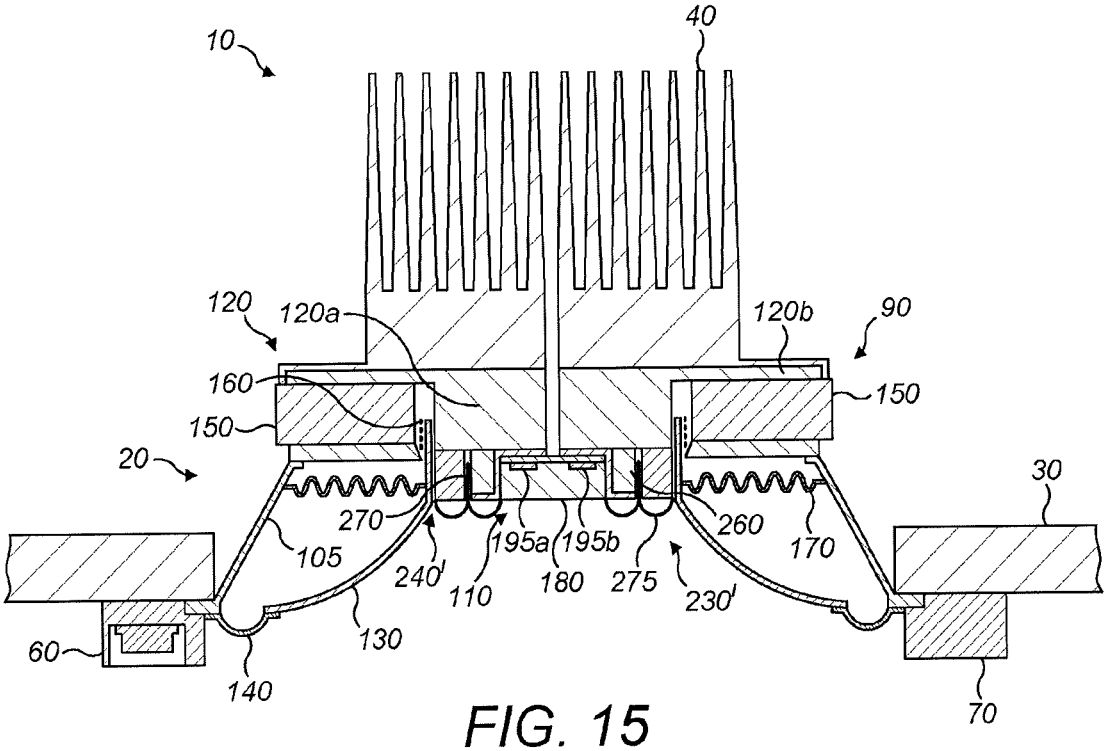
FIG. 15 shows a combined light and loudspeaker driver device in accordance with a further specific embodiment of the present invention.

FIG. 15 shows a detailed view of a combined light and loudspeaker driver device 10 in accordance with a further embodiment of the present invention. The arrangement of FIG. 15 is similar to that of FIG. 6. In FIG. 15, however, the combined light and loudspeaker driver device 10 additionally comprises a tweeter 230'.

The tweeter 230' is a ring radiator tweeter and, hence, ring-shaped. Supporting the tweeter 230' is a housing 240' that is also used to mount the tweeter on the distal end of the heat removal column 120*a*. More specifically, the tweeter 230' is recessed into the distal end of the heat removal column 120*a*. The light source 110 and lens 180 covering the light source 110 are also mounted on and recessed into the distal end of the heat removal column 120. The light source 110 and lens 180 covering the light source are positioned within the centre of the ring-shaped tweeter 230'. The light source 110 is optionally comprised of two LEDs 195*a*, 195*b*.

The tweeter 230' comprises a bi-annular membrane 275 that moves axially to produce high frequency sound. An outer annulus of the membrane 275 is attached to an outer periphery of the distal end of the heat removal column 120*a* and an inner annulus of the membrane 275 is attached to the housing 240' surrounding the light source 110 and lens 180. Rearwardly of the membrane 275 is located a drive unit of the tweeter 230'.

The drive unit includes a tweeter ring-shaped magnet 260 that is supported by the housing 240 and mounted on and recessed into the distal end of the heat removal column 120*a*. The drive unit also includes a tweeter voice coil 270, which is attached to the tweeter membrane 275 between the inner and outer annulus, and positioned between the membrane 275 and the outer periphery of the tweeter ring-shaped magnet 260'. As will be understood, electrical signals supplied to the magnet 260' cause the voice coil 270 to move the membrane 275 and produce sound.

Arranging the tweeter 230' concentrically around the central light source 110 provides both a central light source and central tweeter whist ensuring the two features do not negatively impact upon one other. Central positioning of the light source ensures thermal connection of the light source with the heat removal column 120*a*, which is required for efficient removal of heat from the device 10. Central positioning also ensures that the tweeter and light are positioned to maximize light and sound emission. The tweeter 230' and light source 110 are recessed into the end of the heat removal column 120*a* to ensure that the device 10 remains discreet.

Figure 16:
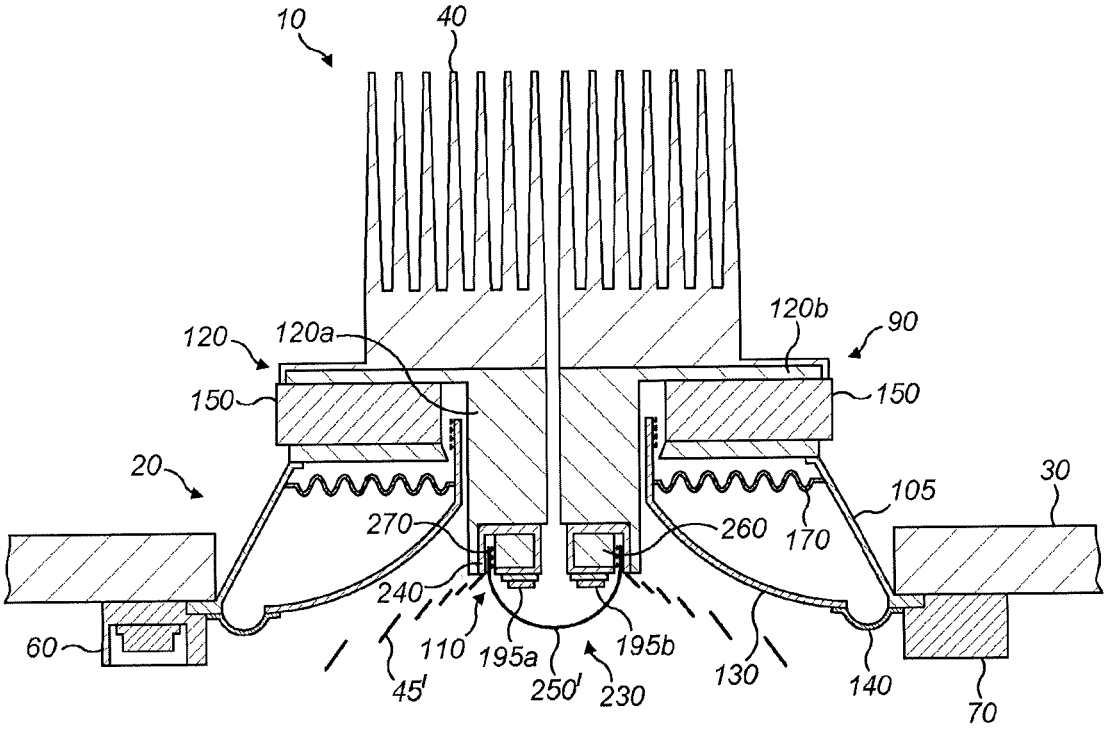
FIG. 16 shows a combined light and loudspeaker driver device in accordance with a further specific embodiment of the present invention.

FIG. 16 shows a detailed view of a combined light and loudspeaker driver device 10 in accordance with a further embodiment of the present invention. Yet again, the arrangement of FIG. 16 is similar to that of FIG. 16. In FIG. 16, by contrast however, the device 10 further includes a speaker grille 45'. The integrated light source 110 and tweeter 230 are recessed into the distal end of the heat removal column 120*a*.

The speaker grille 45' is mounted between the transceiver 60 and the transceiver 70 in front of a front surface of the loudspeaker driver 20. The speaker grille 45' has an aperture that is coaxial with the heat removal column 120*a*. The periphery of the aperture of the speaker grille 45' attaches to the periphery of the distal end of the heat removal column 120*a*.

The speaker grille 45' includes a plurality of reflective surfaces that are concentrically arranged about this central aperture and are angled to reflect light from the light source 110 away from the device. The reflective surfaces are preferably frusto-conical in shape and have successively increasing cone diameters in a direction radially outwardly of the central aperture of the speaker grille 45'. The speaker grille 45' is required to prevent light from striking the diaphragm 130', which would cause light emitted by the device 10 to vary in intensity/flicker.

Figure 17:
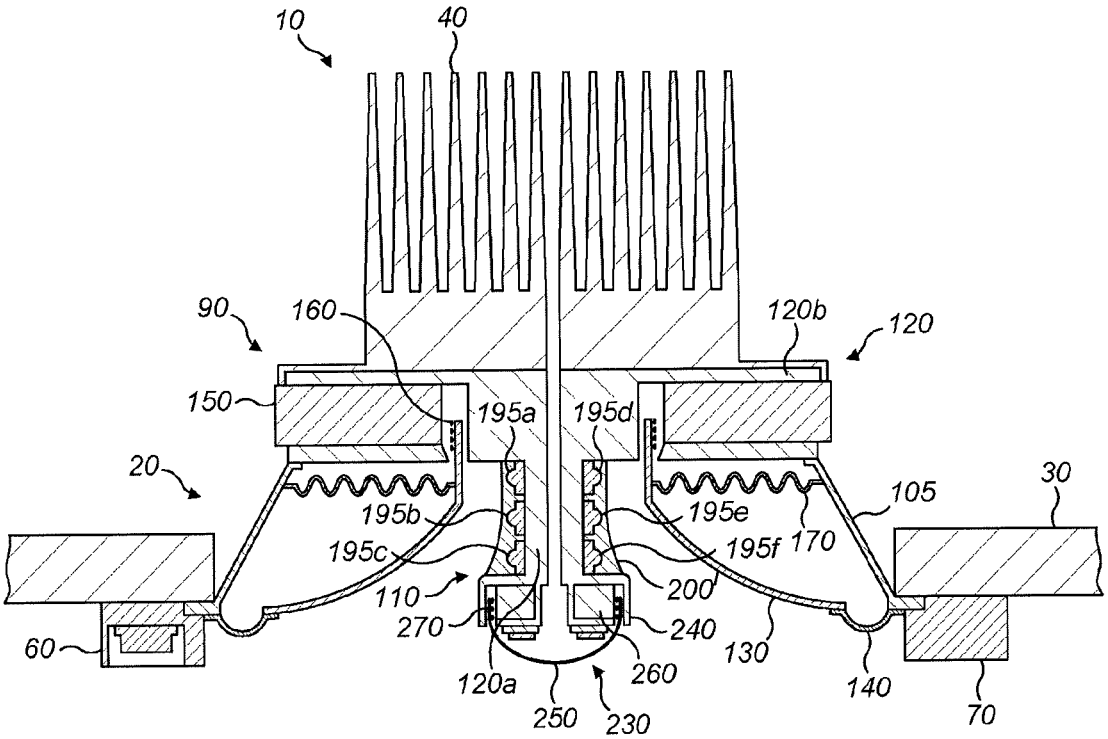
FIG. 17 shows a combined light and loudspeaker driver device in accordance with a further specific embodiment of the present invention.

FIG. 17 shows a detailed view of a combined light and loudspeaker driver device 10 in accordance with a further embodiment of the present invention. The arrangement of FIG. 17 is similar to that of FIG. 6. In contrast to FIG. 6, however, the light source 110 is mounted so as to extend in an axial direction of the device 10, along the length of the heat removal column (ie. between the proximal and distal ends of the heat removal column 120*a*). The central portion of the heat removal column 120*a* on which the light source is mounted is of relatively narrower diameter than the remainder of the heat removal column 120*a* such that the heat removal column 120*a* is generally T-shaped.

The light source 110 is preferably a remote phosphor element. The remote phosphor element comprises a plurality of blue or Ultra Violet (UV) LEDs 195*a-f* mounted equidistantly along the axial extent of the heat removal column 120*a*. Mounted radially outwardly over the LEDs 195*a-f*, around the central portion of the heat removal column 120*a*, is a generally tubular cover member 200' that is either transparent/translucent with a coating or impregnation of a phosphor material, or is formed from a phosphor material. Light from the blue or UV LEDs 195*a-f* excite the phosphor material of the cover member such that diffuse white light is emitted.

The tube shaped cover member 200' is attached to the proximal end of the heat removal column 120*a* adjacent to the base portion 120*b* of the heat removal element. The T-shaped heat removal column 120*a* serves to mask the yellow appearance of the cover member 200' caused by the phosphor material.

The device 10 of FIG. 17 also comprises a tweeter 230 mounted on the distal end of the heat removal column 120*a*. The tweeter 230 is used to produce high frequency sounds and is optionally a dome tweeter. Supporting the tweeter 230 is a housing 240 that is also used to mount the tweeter 230 onto the heat removal column 120*a*. The tweeter 230 includes a tweeter membrane 250 that moves axially to produce sound of a relatively high frequency. Rearwardly and radially inwardly of the tweeter membrane 250 is located a drive unit of the tweeter 230.

The drive unit includes a tweeter ring-shaped magnet 260 that is supported by the housing 240 and is mounted on the heat removal column 120*a*. The drive unit also includes a tweeter voice coil 270 that is attached to the tweeter membrane 250 and positioned between the tweeter membrane 250 and the outer periphery of the tweeter ring-shaped magnet 260. As will be understood, electrical signals supplied to the magnet 260 cause the voice coil 270 to move the tweeter membrane 250 and produce sound.

Supporting the tweeter 230 in the arrangement of FIG. 17 is a housing 240 that is also used to mount the tweeter 230 onto the distal end of the heat removal column 120*a*. In addition to the heat removal column 120*a*, the tweeter is also attached to the end of the tube shaped cover member 200' that is distal from the heat sink 40. The tweeter 230 is positioned such that the tweeter membrane 250 faces towards the room of which the device 10 is a part. This maximizes the emission of high frequency sound.

Figure 18:
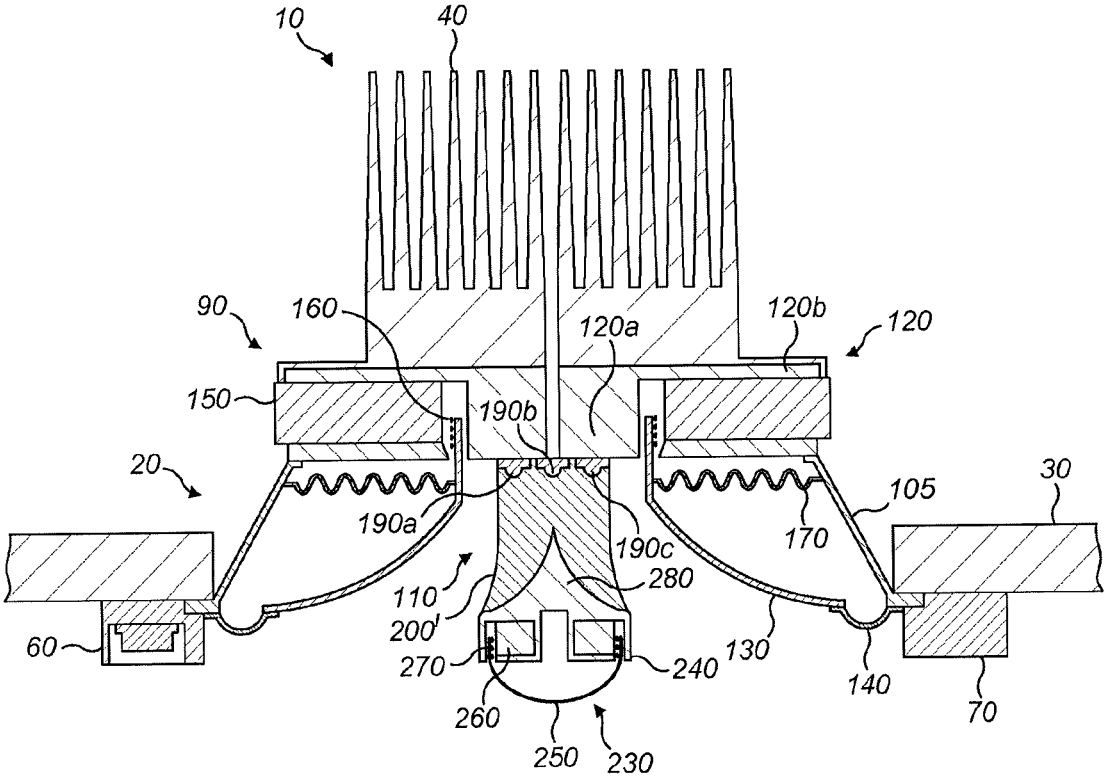
FIG. 18 shows a combined light and loudspeaker driver device in accordance with a further specific embodiment of the present invention.

FIG. 18 shows a detailed view of a combined light and loudspeaker driver device 10 in accordance with an further embodiment of the present invention. The arrangement of FIG. 18 is similar to that of FIG. 6. In FIG. 18, however, the light source is a phosphor element.

The remote phosphor element comprises a plurality of blue or Ultra Violet (UV) LEDs 195*a*, 195*b*, 195*c* and a cover member 200' that is either transparent/translucent with a coating or impregnation of a phosphor material or is formed from a phosphor material. Light from the blue or UV LEDs excites the phosphor material within the cover member 200 such that the phosphor material emits diffuse white light. The blue or UV LEDs 195*a*, 195*b*, 195*c* are mounted on the distal end of the heat removal column 120*a*. The cover member 200' is tube-shaped and positioned coaxially with the heat removal column 120*a*. The tube-shaped cover member 200' is attached to, and extends axially from, the distal end of the heat removal column 120*a*. The heat removal column 120*a* is of a lower aspect ratio than that of FIG. 6. This enables such a light source to be mounted on the heat removal column whilst ensuring that the device 10 remains relatively compact.

The distal end of the tube-shaped cover member 200' is attached to, and supports, a tweeter 230. The tweeter 230 is optionally a dome tweeter as described above in connection with FIG. 17, and is used to produce high frequency sounds. The tweeter 230 is positioned such that the tweeter membrane 250 faces into the room. This positioning optimizes emission of sound from the tweeter 230.

The dome tweeter 230 of FIG. 18 is formed as, or upon, a reflective convex surface 280 that faces rearwardly towards the centre of the diaphragm 130. The convex surface 280 reflects light from the LEDs 195*a*, 195*b*, 195*c* towards the inside of the tube-shaped cover member 200'. This maximizes the amount of light emitted from the device 10 into the room. In a preferred embodiment, the convex surface 280 is conical such that the apex of the surface 280 faces towards the centre of the diaphragm 130.

The light source 110 and tweeter 230, in the arrangement of FIG. 18, are synergistically beneficial. The cover member 200' serves to support the tweeter 230, positioning it centrally of the device 10 and so optimizing the emission of high frequency sound from the device 10. The convex surface 280 of the tweeter 230 serves to maximize the amount of light emitted from the device 10.

Figure 19:
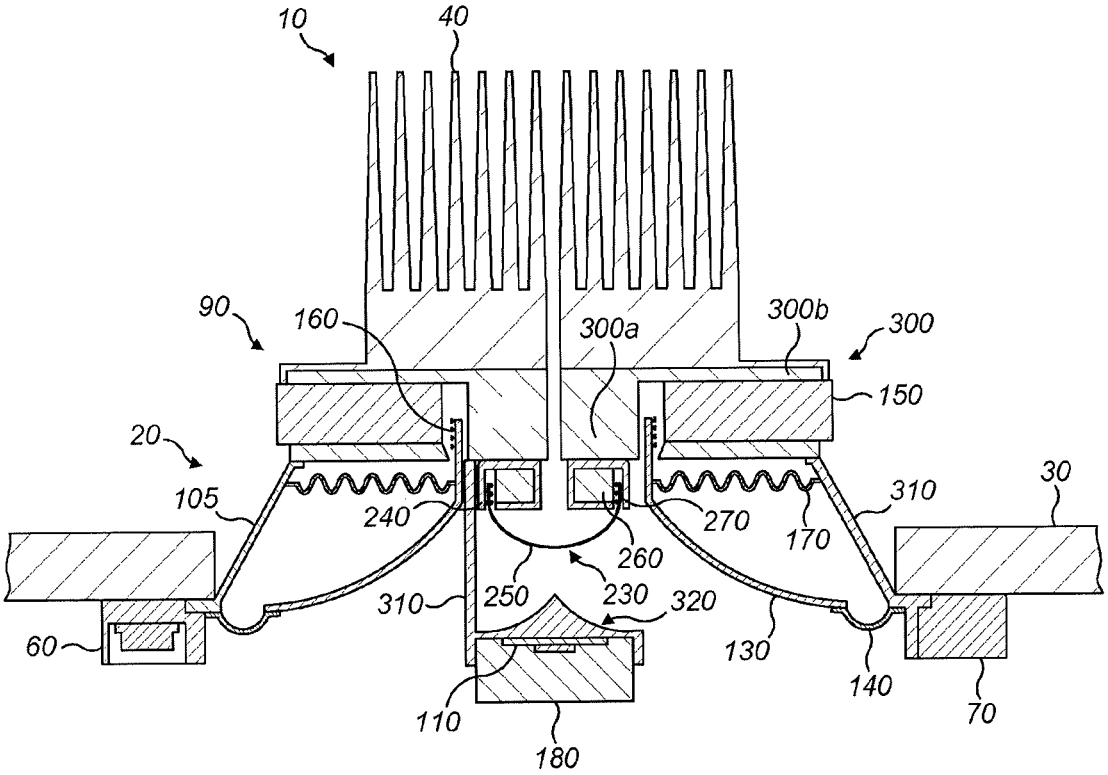
FIG. 19 shows a combined light and loudspeaker driver device in accordance with a further specific embodiment of the present invention.

FIG. 19 shows a detailed view of a combined light and loudspeaker driver device 10 in accordance with a further embodiment of the present invention. The device 10 includes a housing 90 that is, in FIG. 19, in the form of a frustoconical basket 105 that supports the loudspeaker driver 20 and the heat sink 40. In use, the housing 90 is employed to mount the device 10 within an aperture in a ceiling 30 of a room.

The loudspeaker driver 20 includes a diaphragm 130, a roll surround 140, a ring-shaped magnet 150, a voice coil 160 and a spider 170, in a manner similar to that described above in connection with FIG. 6.

The device 10 comprise a thermally conductive mounting member 300 having a relatively high aspect ratio support portion 300*a* extending through the centre of the diaphragm 130 and a second, relatively low aspect ratio base portion 300*b*. The base portion 300*b* of the mounting member 300 mounts and supports the ring-shaped magnet 150 of the drive unit of the loudspeaker driver 20 on a first side facing towards the ceiling aperture, and supports, and is in thermal connection with, the heat sink 40 on a second side facing away from the ceiling aperture.

The device 10 also comprises a tweeter 230. The tweeter 230 is optionally a dome tweeter, as described above with reference to FIG. 17. Supporting the tweeter 230 is a housing 240 that is also used to mount the tweeter 230 onto a distal end of the support portion 300*a* relative to the heat sink 40. The tweeter 230 is positioned such that the tweeter membrane 250 faces into the room when the device 10 is mounted into a ceiling thereof. This maximizes the emission of high frequency sound.

The light source 110 is, in the embodiment of FIG. 19, an LED that is mounted upon a thermally conductive light fitting 320. The LED and its light fitting are mounted on a central axis within the device 10, coaxially with, but spaced from, the support portion 300*a*. Supporting the light fitting of the light source 110 is a heat pipe 310 that also provides a thermal connection between the light source 110 and support portion 300*a*, for efficient removal of heat from the device 10. More specifically, the heat pipe 310 is attached between the periphery of the distal end of the support portion 300*a* and the light fitting 320.

The heat pipe 310 is attached to the periphery of the distal end of the support portion 300*a*, to enable a tweeter 230 also to be mounted on this distal end of the support portion 300*a*. The dome tweeter 230 is as described previously.

The tweeter 230 is coaxially mounted behind the LED and light fitting 320 so that sound emanating from the tweeter is directed towards the rear of the light fitting 320 supporting the LED. For this reason, the rearward facing surface of the light fitting 320 that supports the light source 110—that is, the surface of the light fitting 320 that faces towards the tweeter mounted behind the light source—is curved. In the particular embodiment shown in FIG. 19, the rear surface of the light fitting is in particular a curved sided conical shape (so as to provide radially opposed concave faces) so as to deflect sound from the tweeter 230 around the light source 110 and so maximize sound emission of the device 10.

The combined light and loudspeaker driver device 10 is also provided with first and second transceivers 60 and 70. Each is mounted, as shown in FIG. 19, on the ceiling 30, adjacent to the device 10 when installed in a ceiling 30. The transceivers 60, 70 are otherwise as described above in connection with FIG. 6.

Figure 20:
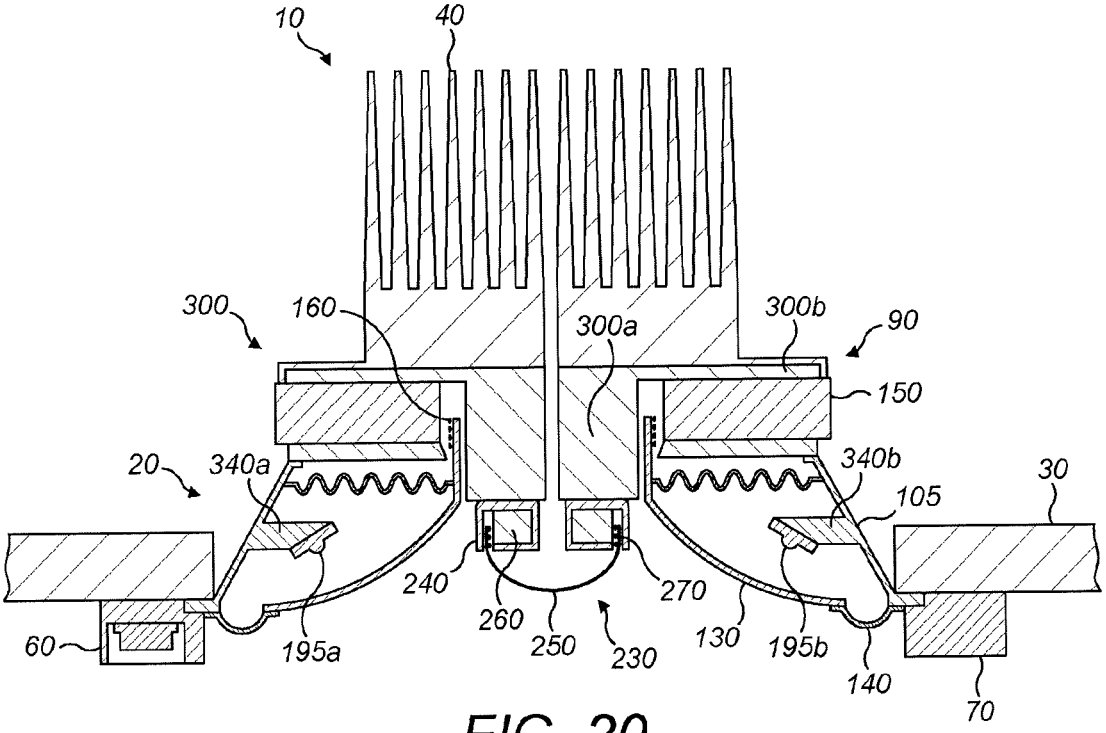
FIG. 20 shows a combined light and loudspeaker driver device in accordance with a further specific embodiment of the present invention.

FIG. 20 shows a detailed view of a combined light and loudspeaker driver device 10 in accordance with a further embodiment of the present invention. The device 10 includes a housing 90 that is in the form of a frustoconical basket 105 that supports the loudspeaker driver 20 and the heat sink 40. In use, the housing 90 is employed to mount the device 10 within an aperture in the ceiling 30.

The loudspeaker driver 20 includes a diaphragm 130, a roll surround 140, a ring-shaped magnet 150, a voice coil 160 and a spider 170, each as described previously. The device 10 comprise a thermally conductive mounting member 300 having a relatively high aspect ratio support portion 300*a* extending through the centre of the diaphragm 130, and a second, relatively low aspect ratio base portion 300*b*. The base portion 300*b* of the mounting member 300 mounts and supports the ring-shaped magnet 150 of the drive unit of the loudspeaker driver 20 on a first side facing towards the ceiling aperture, and supports, and is in thermal connection with, the heat sink 40 on a second side facing away from the ceiling aperture, when the device 10 is mounted in a ceiling 30.

The device 10 also comprises a tweeter 230 as previously described. Supporting the tweeter 230 is a housing 240 that is also used to mount the tweeter 230 onto the distal end of the support portion 300*a*. The tweeter 230 is positioned such that the tweeter membrane 250 faces into the room when the device is mounted in a ceiling 30, in order to optimize high frequency sound emission.

The light source 110 is positioned behind the diaphragm 130 and is preferably formed as two LEDs 195*a*, 105*b*. Each LED is mounted on an arm 340*a*, 340*b* that extends radially inwardly from an inner face of the basket 105. Each arm 340*a*, 340*b* is thermally conductive so as to allow heat generated by the respective LED 195*a*, 195*b* to be conducted, via the basket 105 and the mounting member 300, to the heat sink 40.

The end of each arm 340*a*, 340*b*, upon which a respective LED 195*a*, 195*b* is mounted, is angled such that light from the respective LED 195*a*, 195*b* is directed through the diaphragm 130 and out of the device 10. In the most preferred embodiment, each LED 195*a*, 195*b* is a blue or Ultra Violet (UV) LED and the diaphragm 130 is either transparent with a coating or impregnation of a phosphor material or is formed from a phosphor material. In this exemplary embodiment, the diaphragm forms part of the light emission system to produce a diffuse light source that is a remote phosphor element. Alternatively, the diaphragm can be coated with/impregnated with/formed from a fluorescent material and so, again, form part of the light emission system. In another alternative embodiment, the diaphragm can simply be translucent/transparent to allow transmission of the light from the light source 110 into a room, when the device 10 is mounted in a ceiling or wall thereof.

The combined light and loudspeaker driver device 10 of FIG. 20 is also provided with first and second transceivers 60 and 70. Each is mounted on the ceiling 30, adjacent to the device 10, when the latter is mounted in the ceiling 30.

Figure 21:
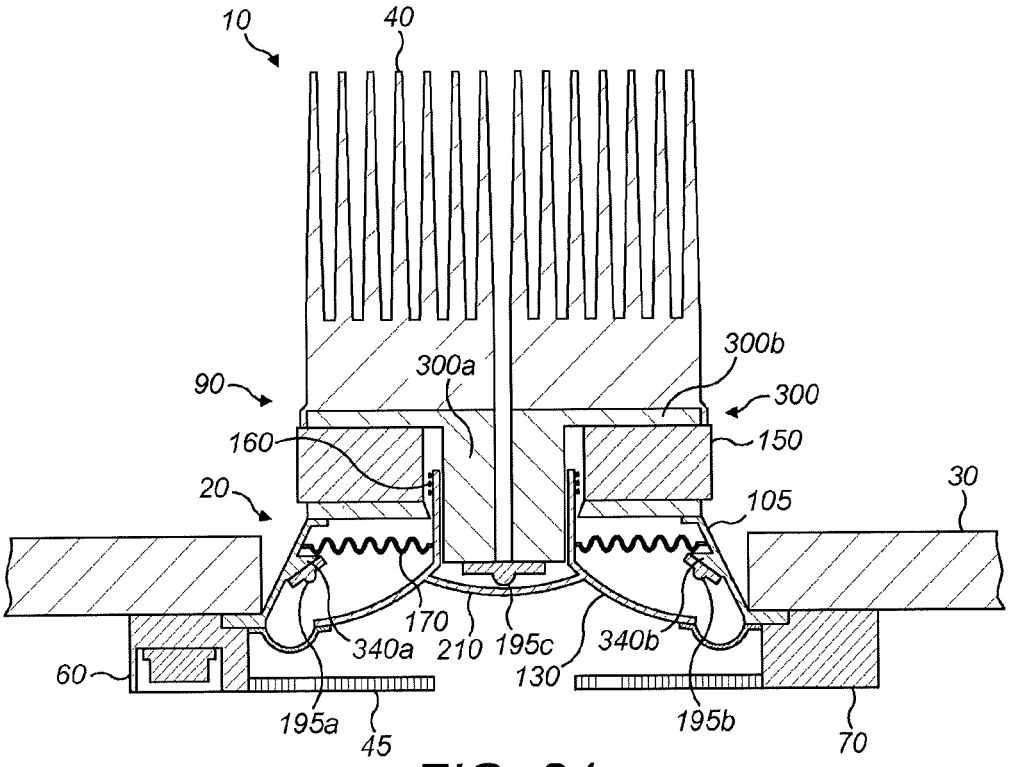
FIG. 21 shows a combined light and loudspeaker driver device in accordance with a further specific embodiment of the present invention.

FIG. 21 shows a detailed view of a combined light and loudspeaker driver device 10 in accordance with a twenty-third embodiment of the present invention. By contrast with the arrangement of FIG. 20, in which a tweeter 230 is mounted upon the distal end of the support portion 300*a* of the mounting member 300, an additional light source 195*c* is instead mounted on that distal end of the support portion 300*a* of the mounting member 300.

A dust cap 210 is attached to the diaphragm 130 in FIG. 21, and positioned in front of the light source 195*c* so as to cover the central aperture of the diaphragm 130 and prevent dust from passing between the rear and front of the diaphragm. In the most preferred embodiment, the light source 195*c* is a blue or Ultra Violet (UV) LED and the dust cap 21 forms a part of the light emission system. The dust cap 210 is either transparent/translucent with a coating or impregnation of a phosphor material or is formed from a phosphor material. Light from the blue or UV LED excites the phosphor material of the dust cap 210 such that the phosphor material emits white light. The dust cap 210 can move freely with the diaphragm 130 and so does not impede the emission of sound from the device 10.

The combined light and loudspeaker driver device 10 also optionally comprises a speaker grille 45 mounted in front of a front surface of the loudspeaker driver 20 between the transceiver 60 and the transceiver 70. The speaker grille 45 is sound diffusive and comprises a central aperture. Hence, light emission from the incandescent light bulb is unaffected by the speaker grille 45.

Figure 22:
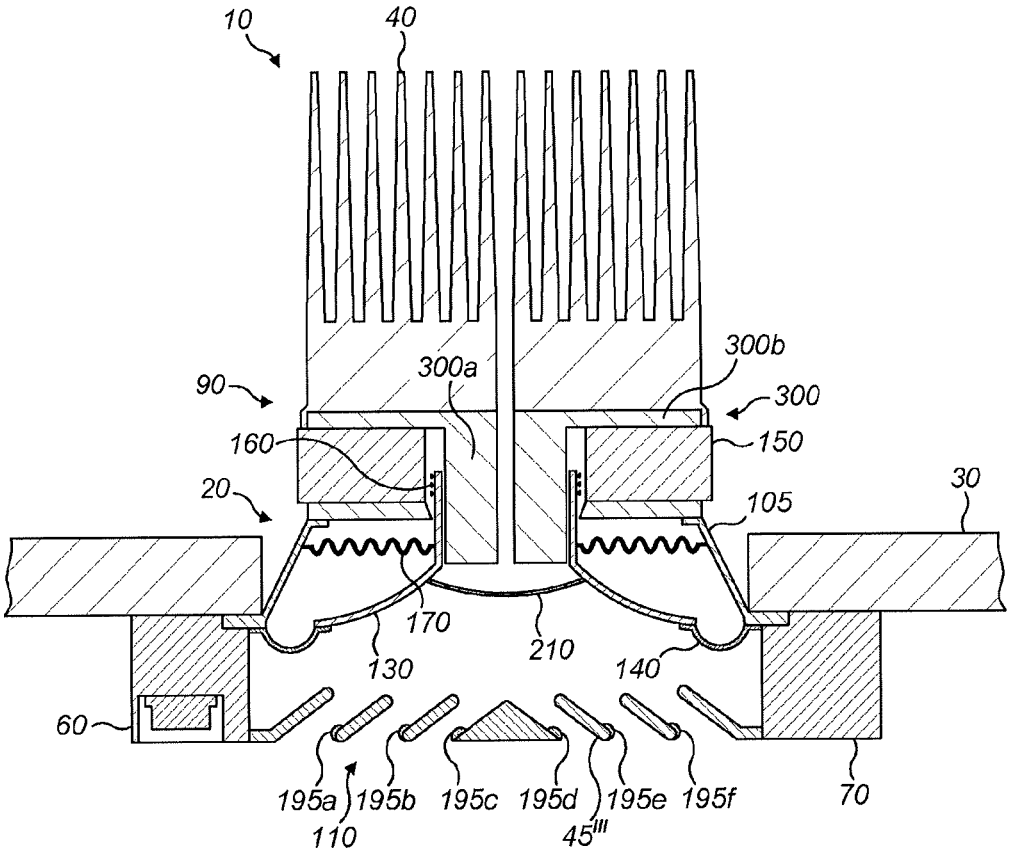
FIG. 22 shows a combined light and loudspeaker driver device in accordance with a further specific embodiment of the present invention.

FIG. 22 shows a detailed view of a combined light and loudspeaker driver device 10 in accordance with a further embodiment of the present invention. The device 10 includes a housing 90 that is, in FIG. 22, in the form of a frustoconical basket 105 that supports the loudspeaker driver 20 and the heat sink 40. In use, the housing 90 is employed to mount the device 10 within an aperture in the ceiling.

The loudspeaker driver 20 includes a diaphragm 130, a roll surround 140, a ring-shaped magnet 150, a voice coil 160 and a spider 170 each as previously described.

The device 10 comprise a thermally conductive mounting member 300 having a relatively high aspect ratio support portion 300*a* extending through the centre of the diaphragm 130 and a second, relatively low aspect ratio base portion 300*b*. The base portion 300*b* of the mounting member mounts and supports the ring-shaped magnet 150 of the drive unit of the loudspeaker driver 20 on a first side facing towards the ceiling aperture, and supports, and is in thermal connection with, the heat sink 40 on a second side facing away from the ceiling aperture.

The combined light and loudspeaker driver device 10 is also provided with first and second transceivers 60 and 70. Each is mounted, as shown in FIG. 20 above, on the ceiling 30, adjacent to the device 10, when the latter is mounted in the ceiling 30.

The device 10 comprises a speaker grille 45''' mounted between the transceiver 60 and the transceiver 70 in front of a front surface of the loudspeaker driver 20. The light source is mounted on the speaker grill 45''' that is reflective so as to reflect light from the light source 110 away from the combined light and loudspeaker driver device 10.

In the most preferred embodiment, as shown in FIG. 22, the speaker grille 45''' comprises a plurality of reflective surfaces that are concentrically arranged and frustoconical in shape. The light source 110 comprises a plurality of lighting elements 195*a-f*, and, optionally, each lighting element is an LED. Each LED 195*a-f* is mounted on each of the reflective surfaces and positioned so as to radiate light towards another one of the reflective surfaces of the speaker grille 45. The speaker grille 45''' is sound diffusive and so does not affect sound emission of the device 10.

The support portion 300*a* has a low aspect ratio such that the distal end of the column 120*a* is positioned within the centre of the diaphragm 130. Therefore, a dust cap 210 is attached to the diaphragm 130 and positioned in front of the distal end of the support portion 300*a*. The dust cap 210 can move freely with the diaphragm 130 and prevents dust from passing between the rear and the front of the diaphragm 130.

Whilst a number of embodiments have been described, it will be understood that this is for the purposes of illustration only and that the invention is not so limited. The skilled reader will envisage various modifications and alternatives. For example, instead of mounting the device 10 on a ceiling of a room, the device 10 could be mounted on a shelf or wall or simply be supported on a framework such that it is free standing.

Figure 23:
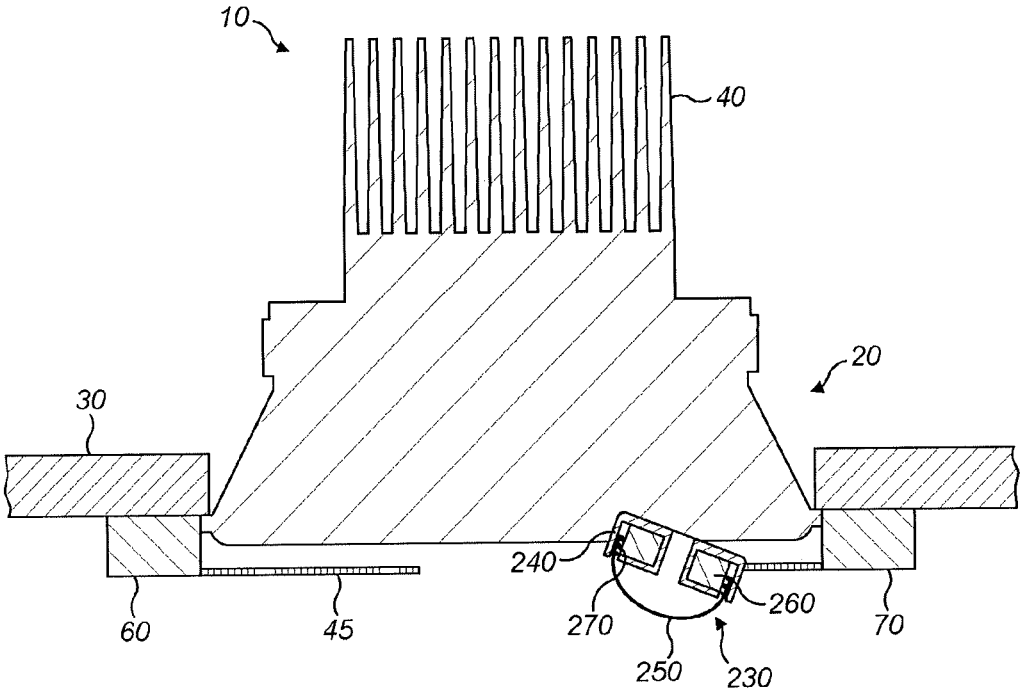
FIG. 23 shows a combined light and loudspeaker driver device in accordance with a further specific embodiment of the present invention.
Figure 24:
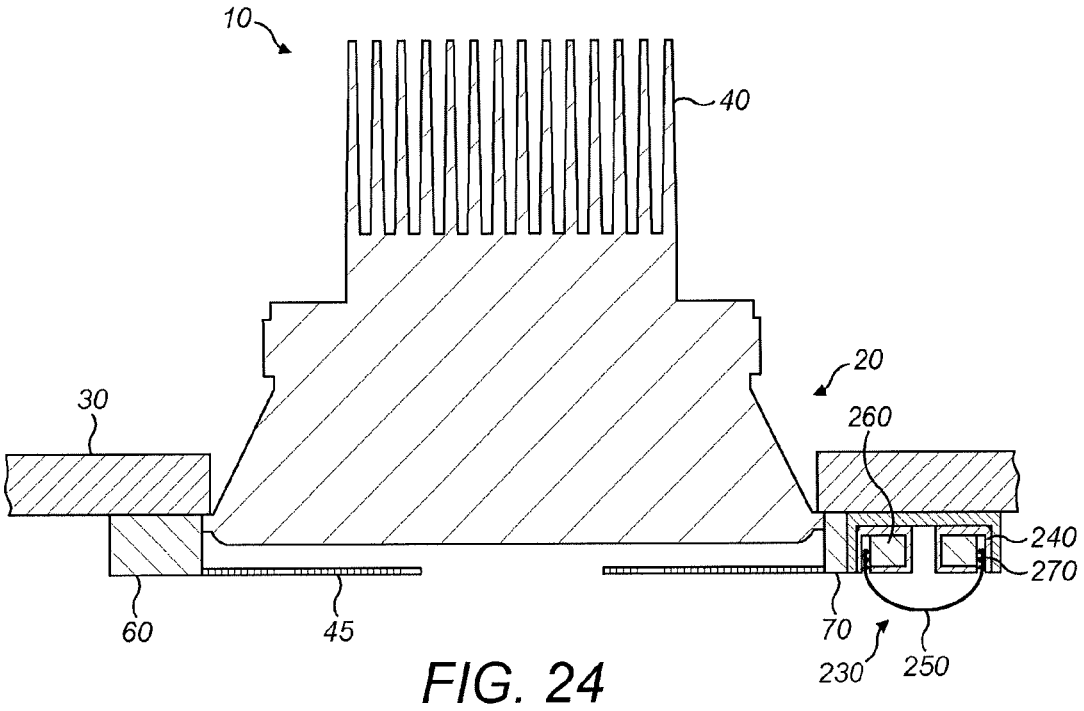
FIG. 24 shows a combined light and loudspeaker driver device in accordance with a further specific embodiment of the present invention.

Moreover, instead of locating the tweeter 230 centrally of the device on a heat removal column 120*a*, or a support portion 300*a*, as shown in the embodiments of FIGS. 13-16 and 17-20, the tweeter 230 could instead be positioned radially off axis, that is, radially outwardly of the central axis of the device 10. Positioning the tweeter radially off axis ensures that the tweeter does not obstruct light emission of the device 10. The tweeter 230 could be located, for example, on the speaker grille 45, as shown in FIG. 23. Alternatively, the tweeter 230 could be located externally of the device 10, for example, it could be mounted on or in the ceiling 30 adjacent to the device 10, as shown in FIG. 24. Here, the position and angle of the tweeter are user adjustable, again as illustrated in FIG. 24.

Figure 25A:
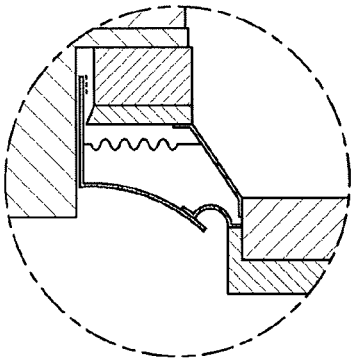
FIGS. 25*a*, 25*b* 25*c*, 25*d*, 25*e*, 25*f* and 25*g* show combined light and loudspeaker driver devices in accordance with further alternative embodiments of the present invention.
Figure 25B:
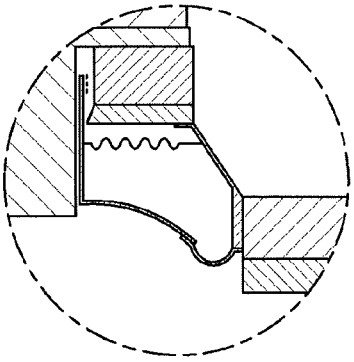
Figure 25C:
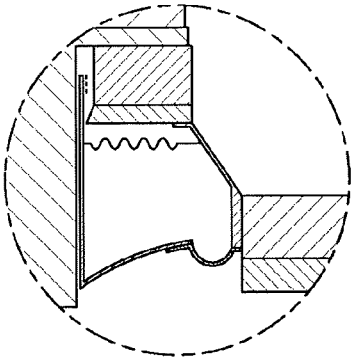
Figure 25D:
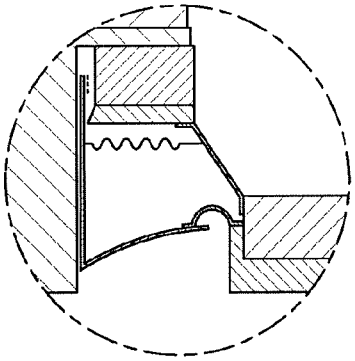
Figure 25E:
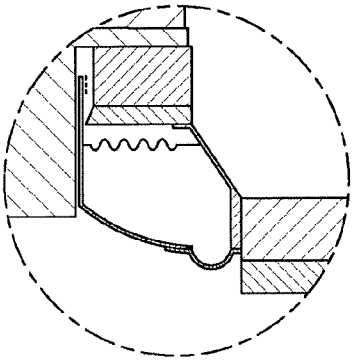
Figure 25F:
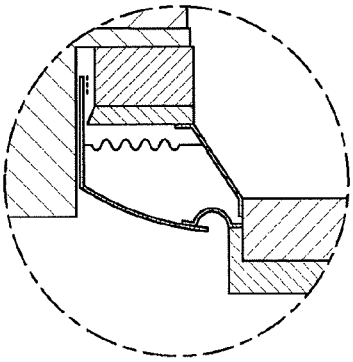

The diaphragm 130 as shown in the embodiments of FIGS. 6-22 is generally cone shaped. Other shapes and sizes of diaphragm are however possible, to provide different audio frequency responses (woofer, sub woofer, mid range and so forth). FIGS. 6-22 illustrate embodiments including a range of generally dome shaped diaphragms, in which the domed diaphragm has a radius equal to or smaller than that of the ceiling aperture. In the embodiments of FIGS. 25*e* and 25*f*, the diaphragm is mounted towards the rear of the basket so that all of the diaphragm sits within the cavity behind the aperture in the ceiling. Alternatively, the diaphragm may be mounted further forward in the basket 105 such that the diaphragm sits generally flush with the ceiling aperture. In another alternative, the dome shaped diaphragm is mounted still further forward in the basket so that the diaphragm extends out into the room when the device is affixed into the aperture in the ceiling.

Figure 25G:
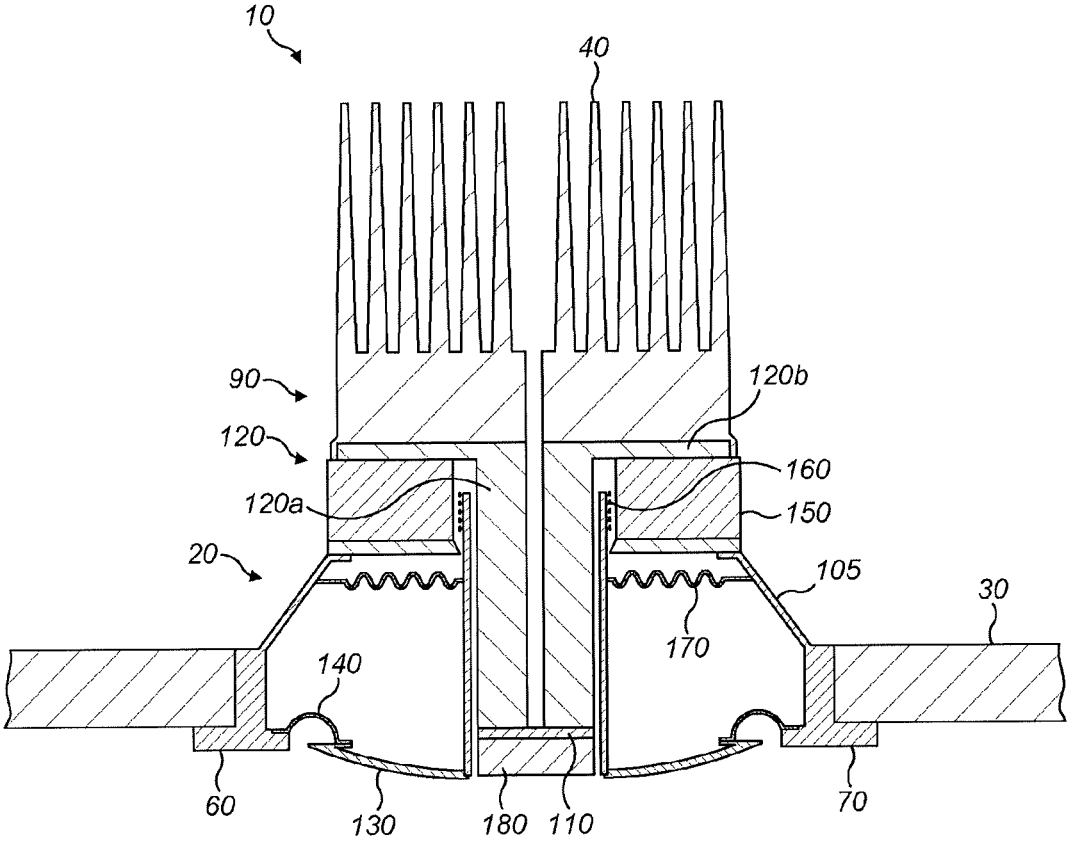

In addition to the cone shapes shown in FIGS. 25*e* and 25*f*, other shapes can be employed. For example, the diaphragm may have a shallower dome shape or alternatively an inverted cone as shown in FIGS. 25*c* and 25*d* or, as shown in FIG. 25*g*, a dome shape with a convex front surface (that is the surface facing into the room when the device 10 is mounted within a ceiling or wall thereof). The roll surround can also be mounted axially inwardly of the diaphragm so as not to be obtrusive, as shown in FIGS. 25*a*, 25*d* and 25*f*.

Still further, the aspect ratio of the heat removal column 120*a* of FIGS. 5-18, and/or the support portion 300*a* of FIGS. 19-22 can be varied to change the appearance of the light source 110 or the spread of the high frequencies from the tweeter 230. The length of the heat removal column may differ so that the light source sits further forward or back along the central axis in the device with respect to the loudspeaker diaphragm.

Although the embodiment of FIG. 19 shows the heat pipe 310 extending between the mounting member 300 and light source 110, the heat pipe can instead extend from the light source 110 directly to the heat sink 40. For example, the heat pipe 310 can extend from the light source 110 to the heat sink 40 along the side of the support portion 300*a* or through a central bore in the support portion 300*a*. In these cases, the mounting member 300 does not need to be thermally conductive.

Various light sources may be employed, and the invention is not limited to the specific light types shown in the Figures. For example, instead of LEDs, MR bulbs (eg those with the well known GU10 fitting), incandescent light bulb, LEDs of a variety of colours and so forth could readily be employed.

In each of the embodiments comprising a light source that is a remote phosphor element, the cover member 200, 200' or tweeter membrane 250' that is coated with/formed of/impregnated with phosphor (FIGS. 9, 14, 16, 17, 18, 20, 21) can be provided with a translucent white coating on the external surface to mask the yellow appearance of the phosphor whilst permitting transmission of light.

Figure 26:
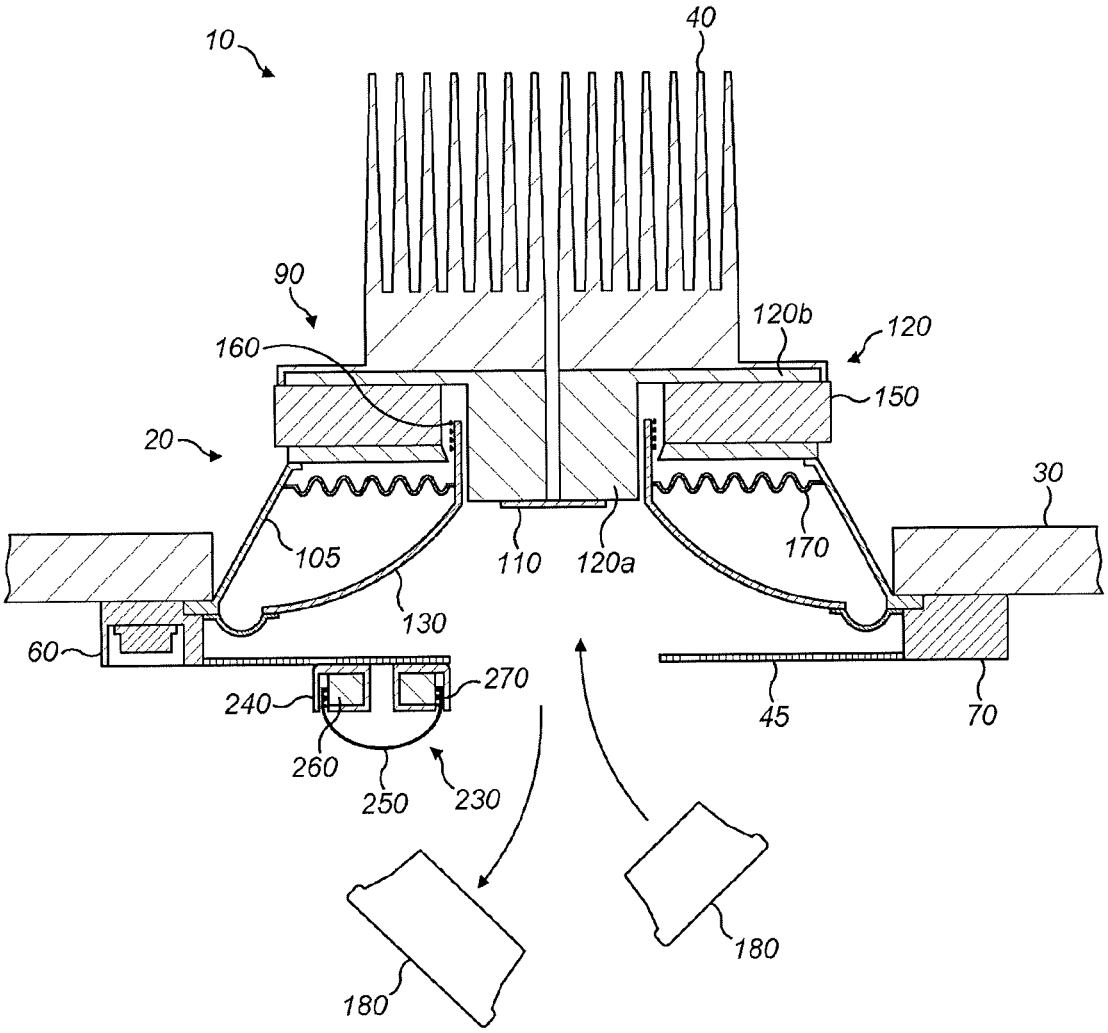
FIG. 26 shows a combined light and loudspeaker driver device in accordance with another embodiment of the present invention.

FIG. 26, the lens 180 may be interchangeable so to produce different light effects.

Furthermore the tweeter 230 and light source 110 may be separately adjustable in position and direction so that the user can customize the light and sound output of the device 10.

Figure 27:
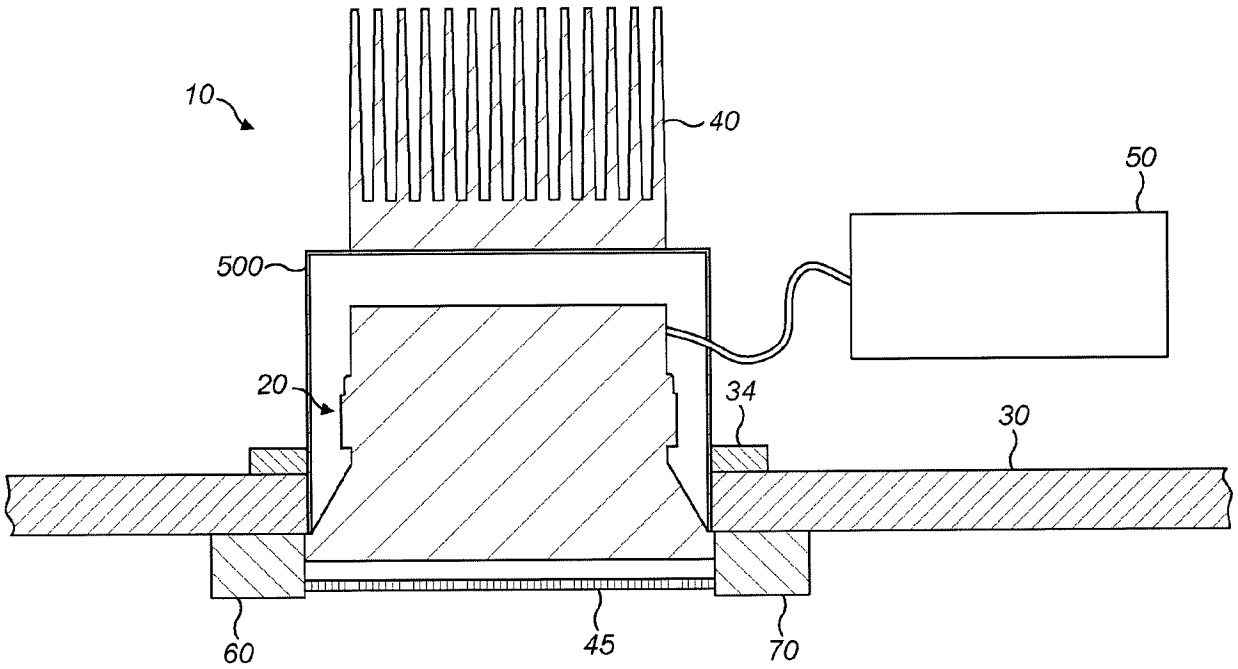
FIG. 27 shows a combined light and loudspeaker driver device in accordance with still a further embodiment of the present invention.

As shown in FIG. 27, the loudspeaker driver 20 of the device 10 can optionally be enclosed by an enclosure 500 that serves to control the volume to the rear of the speaker. The enclosure 350 may also enclose the heat sink 40 in order to optimize the control of the volume at the rear of the speaker. However, the enclosure 350 may be omitted in order that the cavity behind the aperture in the ceiling 30 might improve the bass response.

Figure 28A:
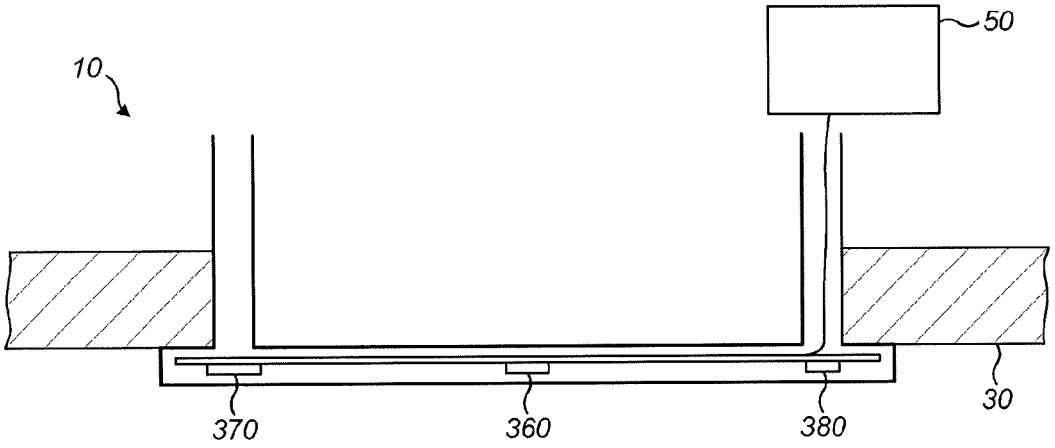
FIGS. 28*a* and 28*b* show combined light and loudspeaker driver devices, in schematic form, in accordance with further alternative embodiments of the present invention.
Figure 28B:
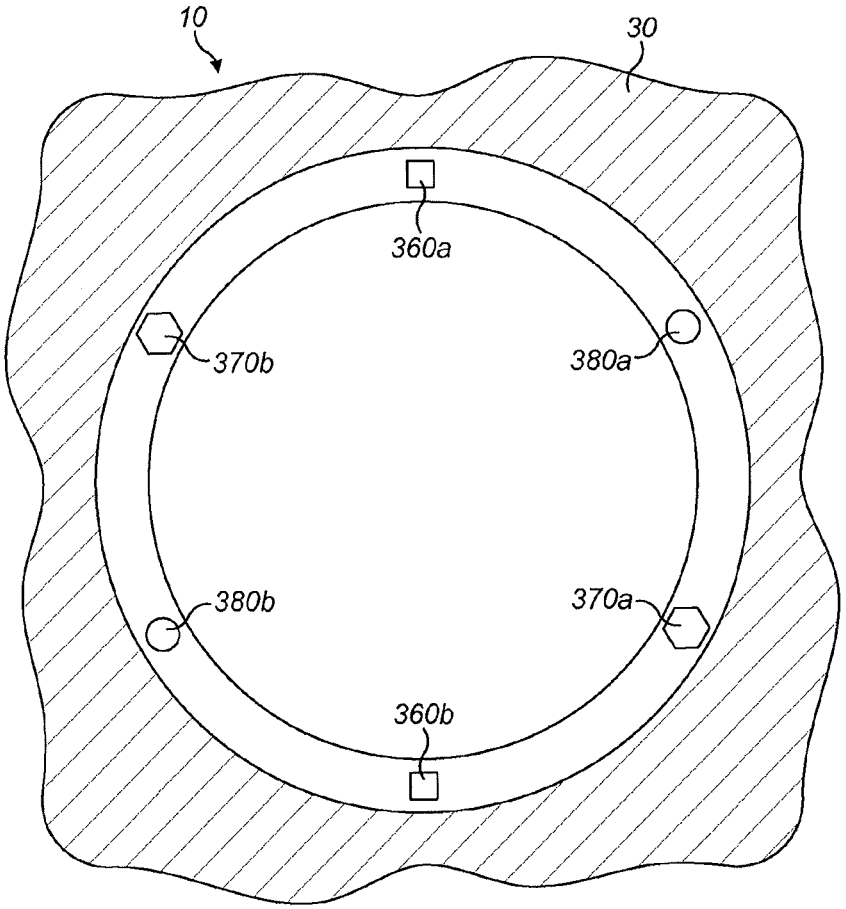

Various components can be configured to pick up commands from a user and provide these to the control box 50 of the combined light and loudspeaker driver device 10. The components are connected to the control box 50 via cable harness that can be, for example, enclosed by the basket 105. FIG. 28*a* shows a schematic diagram of the combined light and loudspeaker driver device 10 comprising sensor 360, antenna 370 and one or more microphones 380. FIG. 28*b* shows the cross-sectional view of the device of FIG. 28*a*. From this view it can be seen that the device 10 comprises two sensors 360*a*, 360*b*, two antennae 370*a*, 370*b* and two microphones 380*a*, 380*b*. The invention is not limited by the number of each of these components. The sensors 360*a*, 360*b*, antennae 370*a*, 370*b* and microphones 380*a*, 380*b* are mounted around a periphery of the aperture in which the device 10 is mounted. These components are mounted on a circuit board either within the room or in the void behind the ceiling. The sensors 360*a*, 360*b*, may be, for example, ambient light sensors, or motion/occupancy sensors.

The device 10 of the various embodiments described may be installed in the same manner as state of the art in-ceiling lights, in part because the audio parts of the device 10 are wirelessly interconnected. This is extremely beneficial because it allows installation without the need for a specialist technician.

The invention claimed is:

1. A combined light and loudspeaker driver device comprising:

a loudspeaker driver having a loudspeaker diaphragm with an opening formed around a central longitudinal axis of the device, the central longitudinal axis defining a forward and a rearward direction of the device; and a housing for supporting the loudspeaker driver; and a light source positioned radially inwardly of the opening of the loudspeaker diaphragm, with respect to the central longitudinal axis and configured to direct light forward and away from the device, wherein the loudspeaker diaphragm is connected to the housing by a flexible roll surround, the flexible roll surround being shaped as an annulus with a convex rearward surface and a concave frontward surface, wherein a forward protrusion of the flexible roll-surround is less than a roll-surround having a convex frontward surface.

2. The device of claim 1:

wherein the light source is configured to direct light away from the loudspeaker diaphragm of the device; and/or wherein the light source is positioned forward of the opening of the loudspeaker diaphragm; and/or wherein the loudspeaker diaphragm is formed as an inverted cone or circular paraboloid.

3. The device of claim 1, further comprising a heat removal element comprising a heat sink having at least an axially central part formed rearwardly of the housing along the central longitudinal axis of the device, and a heat removal column extending from the axially central part of the heat sink in the forward direction along the central longitudinal axis of the device, the light source being mounted at the forward end of the heat removal column.

4. The device of claim 3:

wherein a void is defined between the rear of the loudspeaker diaphragm, a rear portion of the housing immediately adjacent to the axially central part of the heat sink and interior sidewalls of the housing that extend forward from the rear portion of the housing to a front portion of the housing, proximal to the loudspeaker diaphragm, wherein the sidewalls do not converge with the heat removal column in the rearward direction over a majority of the length of the device; and/or wherein the interior of the housing provides an air gap that extends rearwardly parallel to the longitudinal axis from the diaphragm to the rear part of the housing, proximal to the axially central part of the heat sink; and/or wherein the heat sink forms a rearmost part of the housing; and/or wherein the heat sink comprises a plurality of fins, wherein each fin extends in the radial direction from the longitudinal axis.

5. The device of claim 1, wherein the light source comprises one LED or a plurality of LEDs.

6. The device of claim 5, wherein the LED or each LED is a blue or UV LED mounted so as to face toward a cover member that is coated with, impregnated with, or formed from, a phosphor material.

7. The device of claim 6:

wherein the cover member forms an enclosure for the blue or UV LED(s); and/or wherein the external surface of the cover member comprises a translucent, white coating.

8. The device of claim 1, further comprising a lens or lens array mounted in front of the light source.

9. The device of claim 8:

wherein the lens or lens array is removably mounted in front of the light source; and/or wherein the lens or lens array is magnetically or mechanically mounted in front of the light source.

10. The device of claim 1, further comprising a dome tweeter having a tweeter membrane in the form of a dome, wherein the light source is positioned behind the tweeter membrane, and wherein the tweeter membrane is configured to receive light generated by the light source and to transmit or radiate the received light away from the device, particularly away from the loudspeaker diaphragm of the device.

11. The device of claim 10, wherein the tweeter membrane is formed of, coated with, or impregnated with a fluorescent or phosphorescent material adapted to receive light generated by the light source, absorb the received light and emit light away from the device.

12. The device of claim 1, further comprising:

a ring radiator tweeter positioned radially inwardly of the opening in the loudspeaker diaphragm and radially outwardly of the light source, with respect to the longitudinal axis.

13. The device of claim 1, further comprising a speaker grille mounted forward of a front surface of the loudspeaker diaphragm.

14. The device of claim 13:

wherein the speaker grille is either light diffusive and/or transparent/translucent; and/or wherein the speaker grille comprises an aperture to allow egress of light from the light source away from the device; and/or wherein the speaker grille comprises an aperture to allow egress of light from the light source away from the device, and wherein the speaker grille has a plurality of reflective surfaces concentric with the aperture, each arranged to reflect light from the light source away from the device; and/or wherein the speaker grille comprises an aperture to allow egress of light from the light source away from the device, and wherein the device further comprises a secondary lens positioned in the aperture of the grille.

15. The device of claim 1, further comprising a microphone, and a wireless transceiver configured to receive and transmit audio and electrical signals to control the light and sound.

* * * * *